US011892212B2

(12) United States Patent
Li et al.

(10) Patent No.: US 11,892,212 B2
(45) Date of Patent: Feb. 6, 2024

(54) GAS-LIQUID SEPARATOR AND AIR CONDITIONING SYSTEM

(71) Applicant: ZHEJIANG SANHUA INTELLIGENT CONTROLS CO., LTD., Shaoxing (CN)

(72) Inventors: Li Li, Shaoxing (CN); Mei Wang, Shaoxing (CN); Junqi Dong, Shaoxing (CN)

(73) Assignee: ZHEJIANG SANHUA INTELLIGENT CONTROLS CO., LTD., Shaoxing (CN)

( * ) Notice: Subject to any disclaimer, the term of this patent is extended or adjusted under 35 U.S.C. 154(b) by 363 days.

(21) Appl. No.: 17/270,857

(22) PCT Filed: Aug. 22, 2019

(86) PCT No.: PCT/CN2019/101990
§ 371 (c)(1),
(2) Date: Feb. 23, 2021

(87) PCT Pub. No.: WO2020/038437
PCT Pub. Date: Feb. 27, 2020

(65) Prior Publication Data

US 2021/0247114 A1 Aug. 12, 2021

(30) Foreign Application Priority Data

Aug. 23, 2018 (CN) ..... 201810968969.6
Aug. 23, 2018 (CN) ..... 201810969629.5
(Continued)

(51) Int. Cl.
*F25B 43/00* (2006.01)
*F25B 13/00* (2006.01)

(52) U.S. Cl.
CPC ..... *F25B 43/006* (2013.01); *F25B 13/00* (2013.01)

(58) Field of Classification Search
CPC ..... F25B 43/006; F25B 13/00
See application file for complete search history.

(56) References Cited

U.S. PATENT DOCUMENTS 5,277,807 A 1/1994 Lavoie et al.
6,125,651 A * 10/2000 Tack ..... F25B 43/006 62/503
(Continued)

FOREIGN PATENT DOCUMENTS

CN 2064677 U 10/1990
CN 101672553 A 3/2010
(Continued)

OTHER PUBLICATIONS

Hosokawa (JP2013130385A), English Translation, Gas-Liquid Separator, Jul. 4, 2023, Whole Document (Year: 2013).*
(Continued)

*Primary Examiner* — Larry L Furdge
*Assistant Examiner* — Keith Stanley Myers
(74) *Attorney, Agent, or Firm* — Cheng-Ju Chiang

(57) ABSTRACT

A gas-liquid separator includes a first cylinder, a second cylinder and a heat exchange assembly. The first cylinder is surrounded by the second cylinder at a predetermined distance. The heat exchange assembly is arranged between the first cylinder and the second cylinder. The heat exchange assembly includes a collecting pipe. An extension direction of the collecting pipe is parallel to an axial direction of the first cylinder. At least a part of a side wall surface of the first cylinder is formed with an avoidance portion recessed inwardly. At least a part of the collecting pipe is arranged between the avoidance portion and the second cylinder.

20 Claims, 40 Drawing Sheets

(30) Foreign Application Priority Data

Aug. 23, 2018 (CN) ..... 201810969630.8
Aug. 23, 2018 (CN) ..... 201821368979.8

(56) References Cited

U.S. PATENT DOCUMENTS

| | | | | |
|---|---|---|---|---|
| 6,463,757 | B1 | 10/2002 | Dickson et al. | |
| 6,523,365 | B2 | 2/2003 | Zhang et al. | |
| 8,945,257 | B2 * | 2/2015 | Moens | B01D 46/0004 55/459.1 |
| 2003/0121648 | A1 | 7/2003 | Hong et al. | |
| 2006/0080997 | A1 | 4/2006 | Haussmann | |
| 2006/0254310 | A1 * | 11/2006 | Kamsma | F25B 39/04 62/509 |
| 2008/0000261 | A1 | 1/2008 | Klotten et al. | |
| 2009/0044563 | A1 | 2/2009 | Heckt et al. | |
| 2015/0053085 | A1 | 2/2015 | Mahley, III | |
| 2020/0047098 | A1 * | 2/2020 | Zapletal | F25B 31/002 |

FOREIGN PATENT DOCUMENTS

| | | | | |
|---|---|---|---|---|
| CN | 201508084 | U | 6/2010 | |
| CN | 201637310 | U | 11/2010 | |
| CN | 102109253 | A | 6/2011 | |
| CN | 102292135 | A | 12/2011 | |
| CN | 202304145 | U | 7/2012 | |
| CN | 102645061 | A | 8/2012 | |
| CN | 103808088 | A | 5/2014 | |
| CN | 203837333 | U | 9/2014 | |
| CN | 105066523 | A | 11/2015 | |
| CN | 105202830 | A | 12/2015 | |
| CN | 105241134 | A | 1/2016 | |
| CN | 105805990 | A | 7/2016 | |
| CN | 205980484 | U | 2/2017 | |
| CN | 206037507 | U | 3/2017 | |
| CN | 107187295 | A | 9/2017 | |
| CN | 206755672 | U | 12/2017 | |
| CN | 207585095 | U | 7/2018 | |
| CN | 207729881 | U | 8/2018 | |
| CN | 208832787 | U | 5/2019 | |
| DE | 3119440 | A1 | 12/1982 | |
| DE | 102014005576 | A1 | 10/2015 | |
| DE | 102015217634 | A1 * | 5/2017 | F25B 43/006 |
| EP | 1647792 | A2 | 4/2006 | |
| EP | 1961597 | A1 | 8/2008 | |
| EP | 2118608 | B1 | 4/2011 | |
| JP | 2001-96139 | A | 4/2001 | |
| JP | 2007-278688 | A | 10/2007 | |
| JP | 2013-130385 | A | 7/2013 | |
| WO | 02/095303 | A1 | 11/2002 | |
| WO | 2008/113714 | A1 | 9/2008 | |

OTHER PUBLICATIONS

Wang (CN207585095U), English Translation, Heat Pump Water Heater Microchannel Water Tank, Jul. 6, 2018, Whole Document (Year: 2018).*

Feuerecker (DE102015217634A1), English Translation, Device of an air conditioning system with an internal heat exchanger and an integrated collector, May 11, 2017, Whole Document (Year: 2017).*

* cited by examiner

GAS-LIQUID SEPARATOR AND AIR CONDITIONING SYSTEM

The present application is a 35 U.S.C. § 371 National Phase conversion of International (PCT) Patent Application No. PCT/CN2019/101990, filed on Aug. 22, 2019, which claims priority of Chinese Patent Application No. 201821368979.8, filed on Aug. 23, 2018, Chinese Patent Application No. 201810969629.5, filed on Aug. 23, 2018, Chinese Patent Application No. 201810969630.8, filed on Aug. 23, 2018, Chinese Patent Application No. 201810968969.6, filed on Aug. 23, 2018, the disclosure of which is incorporated by reference herein. The PCT International Patent Application was filed and published in Chinese.

TECHNICAL FIELD

This application relates to a field of air conditioning technology, and in particular to a gas-liquid separator and an air conditioning system.

BACKGROUND

In an air conditioning system, an intermediate heat exchanger is often used to exchange heat between the low-temperature refrigerant from the evaporator and the high-temperature refrigerant from the condenser in order to increase the temperature of the refrigerant entering the compressor and lower the temperature of the refrigerant before throttling, thereby increasing the cooling efficiency of the air conditioning system. Usually, most compressors can only compress gaseous refrigerant. If liquid refrigerant enters the compressor, it will cause liquid shock and damage the compressor. In order to avoid the compressor being shocked by liquid refrigerant, it is necessary to install a gas-liquid separator before the compressor.

In addition, different refrigerants have different pressure requirements for the air conditioning systems. Compared with the use of a low-pressure refrigerant, when using a high-pressure refrigerant, the working pressure of the air-conditioning system is greater, and higher requirements are placed on the pressure resistance of the gas-liquid separator, especially higher requirements are placed on the strength of components such as collecting pipes which circulate the high-temperature refrigerant. While ensuring that the flow rate in the pipes is within a reasonable range and is limited by the size of the gas-liquid separator, how to make the strength of the components such as collecting pipes that circulate the high-temperature refrigerant meet the requirements and how to make the structure of the gas-liquid separator more compact, has become an urgent problem to be solved.

SUMMARY

According to a first aspect of embodiments of the present application, a gas-liquid separator is provided. The gas-liquid separator includes a first cylinder, a second cylinder and a heat exchange assembly. The second cylinder is surrounded by the first cylinder at a predetermined distance. The heat exchange assembly is arranged between the first cylinder and the second cylinder. The heat exchange assembly includes a collecting pipe, and an extension direction of the collecting pipe being parallel to an axial direction of the first cylinder. At least a part of a side wall surface of the first cylinder is formed with an avoidance portion recessed inwardly, and at least a part of the collecting pipe is arranged between the avoidance portion and the second cylinder.

According to a second aspect of embodiments of the present application, an air conditioning system is provided. The air conditioning system at least includes a heat exchanger and a compressor which are connected by pipelines. The gas-liquid separator described above is arranged between the heat exchanger and the compressor. The first cylinder is provided with a chamber. An inlet of the chamber is in communication with an outlet of the heat exchanger. An outlet of an interlayer space between the first cylinder and the second cylinder communicates with an inlet of the compressor.

DETAILED DESCRIPTION

Exemplary embodiments will be described in detail here, examples of which are shown in drawings. When the following description refers to the drawings, unless otherwise indicated, the same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present application includes two or more.

Hereinafter, some embodiments of the present application will be described in detail with reference to the accompanying drawings. In the case of no conflict, the following embodiments and features in the embodiments can be combined with each other.

Figure 1:
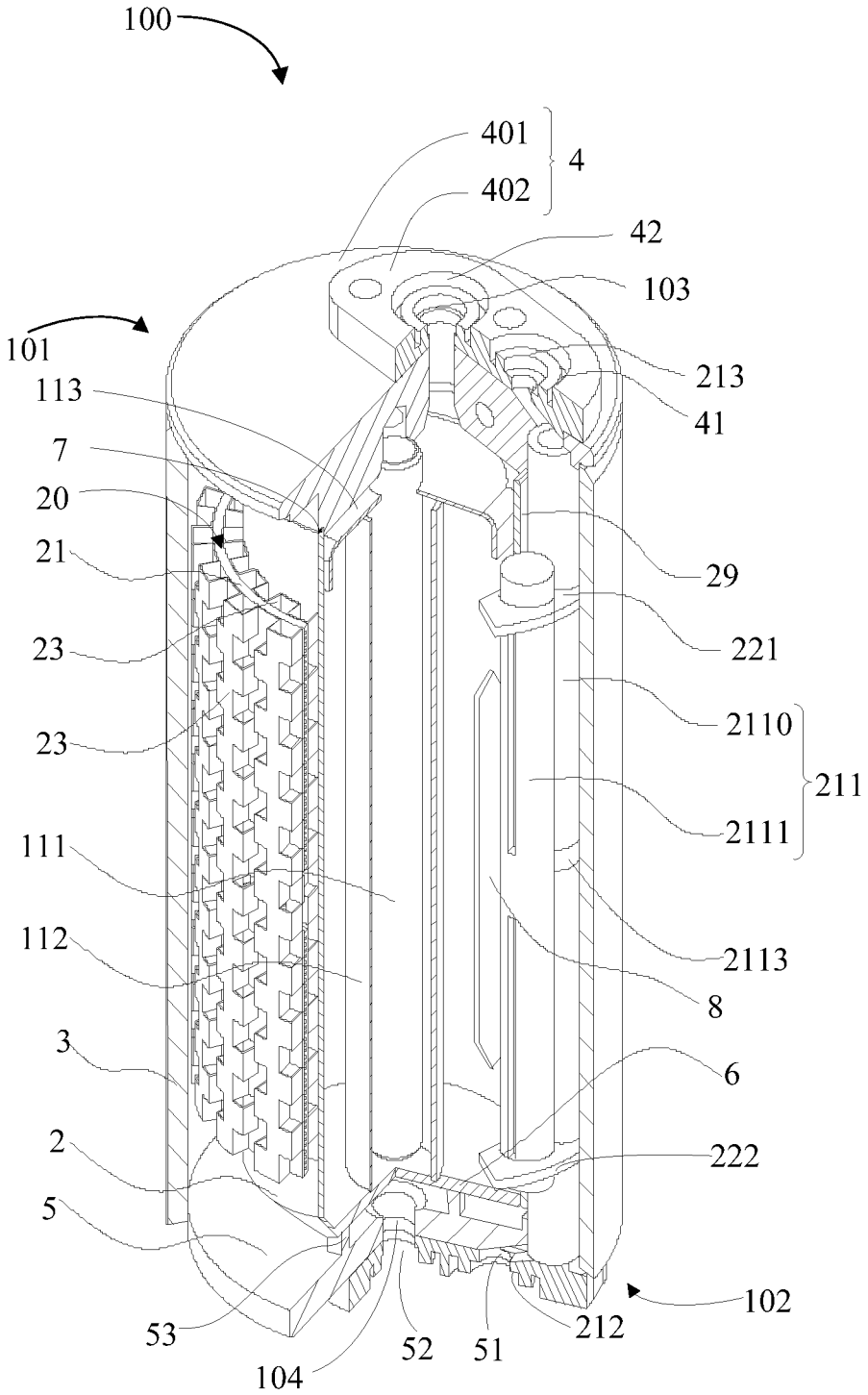
FIG. 1 is a schematic view of a perspective structure of a gas-liquid separator in accordance with an exemplary embodiment of the present application.

FIG. 1 is a schematic view of a perspective structure of a gas-liquid separator of an exemplary embodiment of the present application. The gas-liquid separator can be applied to various refrigeration systems, and is suitable for many fields such as household air conditioners, commercial air conditioners and automobiles. Please refer to FIG. 55, a refrigeration system, for example an air conditioning system, is shown. The refrigeration system includes a heat exchanger, a condenser, an expansion valve and a compressor which are connected by pipelines. A gas-liquid separator 100 is provided between the heat exchanger and the compressor.

As shown in FIG. 1, the gas-liquid separator 100 includes a first cylinder 2 and a second cylinder 3 surrounded by the first cylinder 2 at a predetermined distance. An interlayer space 202 in which a refrigerant (i.e., a first refrigerant) flows is provided between the first cylinder 2 and the second cylinder 3. At least a part of a side wall of the first cylinder 2 is recessed inwardly to form an avoidance portion 29. The avoidance portion 29 may be formed by a part of a cylindrical wall of the first cylinder 2 which is recessed or bent inwardly. In specific implementations, a stamping process can be used to form the avoidance portion 29. Of course, other processes can also be used to form the avoidance portion, which is not limited in the present application and can be set according to the specific application environment.

The gas-liquid separator 100 has a first end 101 and a second end 102 which are opposite to each other. Unless otherwise specified, the first end 101 can be regarded as an upper end, and the second end 102 can be regarded as a lower end. Among them, the upper end and the lower end are only for convenience of description, and are not limited to one position or one spatial orientation.

In some embodiments, both the first cylinder 2 and the second cylinder 3 are hollow cylinders, and an outer diameter of the first cylinder 2 is smaller than an inner diameter of the second cylinder 3. A chamber 201 is formed in the first cylinder 2, and a gas-liquid separation assembly 11 is provided in the chamber 201. Relevant content of the gas-liquid separation assembly 11 will be described in detail in the following embodiments, and will not be repeated here.

The interlayer space 202 may be a cavity enclosed by an outer wall surface of the first cylinder 2 and an inner wall surface of the second cylinder 3. Optionally, a lower end surface of the first cylinder 2 is higher than a lower end surface of the second cylinder 3. Correspondingly, the lower end of the first cylinder 2 is provided with an inner end cover 6 so as to isolate the chamber 201 from the interlayer space 202.

Furthermore, the gas-liquid separator 100 includes a heat exchange assembly 20 arranged in the interlayer space 202. The heat exchange assembly 20 includes flat tubes 21 and a collecting pipe 211 arranged at an end of the flat tubes 21. The end of the flat tube 21 is inserted into the collecting pipes 211 to make an internal space of the flat tube 21 communicate with an internal space of the collecting pipe 211. The collecting pipe 211 extends in a direction parallel to an axial direction r of the first cylinder 2, and at least a part of the collecting pipe 211 is provided corresponding to the avoidance portion 29. This makes the structure of the gas-liquid separator more compact, so that the disposed position of the collecting pipe is offset close to the axis of the first cylinder. That is, the distance between the end of the collecting pipe and the second cylinder is increased, so that an end cover of the gas-liquid separator has enough space to set the joint which is connected to the end of the collecting pipe. In addition, the collecting pipe extends along the axial direction of the first cylinder, and for example, the collecting pipe with an increased pipe diameter may be provided at least partially corresponding to the avoidance portion. At least a part of the collecting pipe is arranged between the avoidance portion and the second cylinder. In this way, when an overall size of the gas-liquid separator remains unchanged, the pressure resistance strength of the collecting pipe increases. The term "corresponding" in the description "the collecting pipe 211 is provided corresponding to the avoidance portion 29" means that at least a part of the avoidance portion 29 is adjacent to a wall surface on the side of the collecting pipe 211, is attached or adjacent to or has a small gap due to manufacturing process with at least part of an outer wall surface of the collecting pipe 211. Furthermore, the shape and size of the avoidance portion 29 are substantially the same as the shape and size of a side of the collecting pipe 211 adjacent to the avoidance portion 29, and the avoidance portion 29 and the collecting pipe 211 are mating with each other. Correspondingly, the interlayer space 202 is a passage for the first refrigerant, and the internal space of the flat tube 21 is a passage for the second refrigerant. Optionally, the first refrigerant is a low-temperature refrigerant, and the second refrigerant is a high-temperature refrigerant.

In some embodiments, the flat tube 21 includes a plurality of flat pipes which are arranged in parallel along the same direction and surround the outer wall surface of the first cylinder 2. The flat tube 21 may be attached to the outer wall surface of the first cylinder 2, so that heat exchange between the interlayer space 202 and the flat tube 21 is realized by the heat radiation from the outer wall surface of the first cylinder 2. The second refrigerant passage and the first refrigerant passage of the gas-liquid separator 100 are provided separately, so that the structure is simplified and there is no risk of mixing of refrigerants in two states in case of pipeline leakage.

In another embodiment, the outer wall surface of the flat tube 21 is attached to the inner wall surface of the second cylinder 3. The flat tube 21 is spirally wrapped around the inner wall of the second cylinder 3 or disposed with other cross-sectional shapes.

In other embodiments, the flat tube 21 is not attached to the outer wall surface of the first cylinder 2 and the inner wall surface of the second cylinder 3, rather than being separated by a certain distance.

For example, in some embodiments, the flat tube 21 includes a plurality of flat pipes which are arranged side by side. Correspondingly, the flat pipes are inserted into the collecting pipe 211. The second refrigerant may flow in a same direction in the flat pipes. Since the flat tube 21 is arranged in the interlayer space, the second refrigerant flows in the flat pipes. Therefore, the heat of the second refrigerant is exchanged with the first refrigerant in the interlayer space through pipe walls of the flat pipes.

Figure 28:
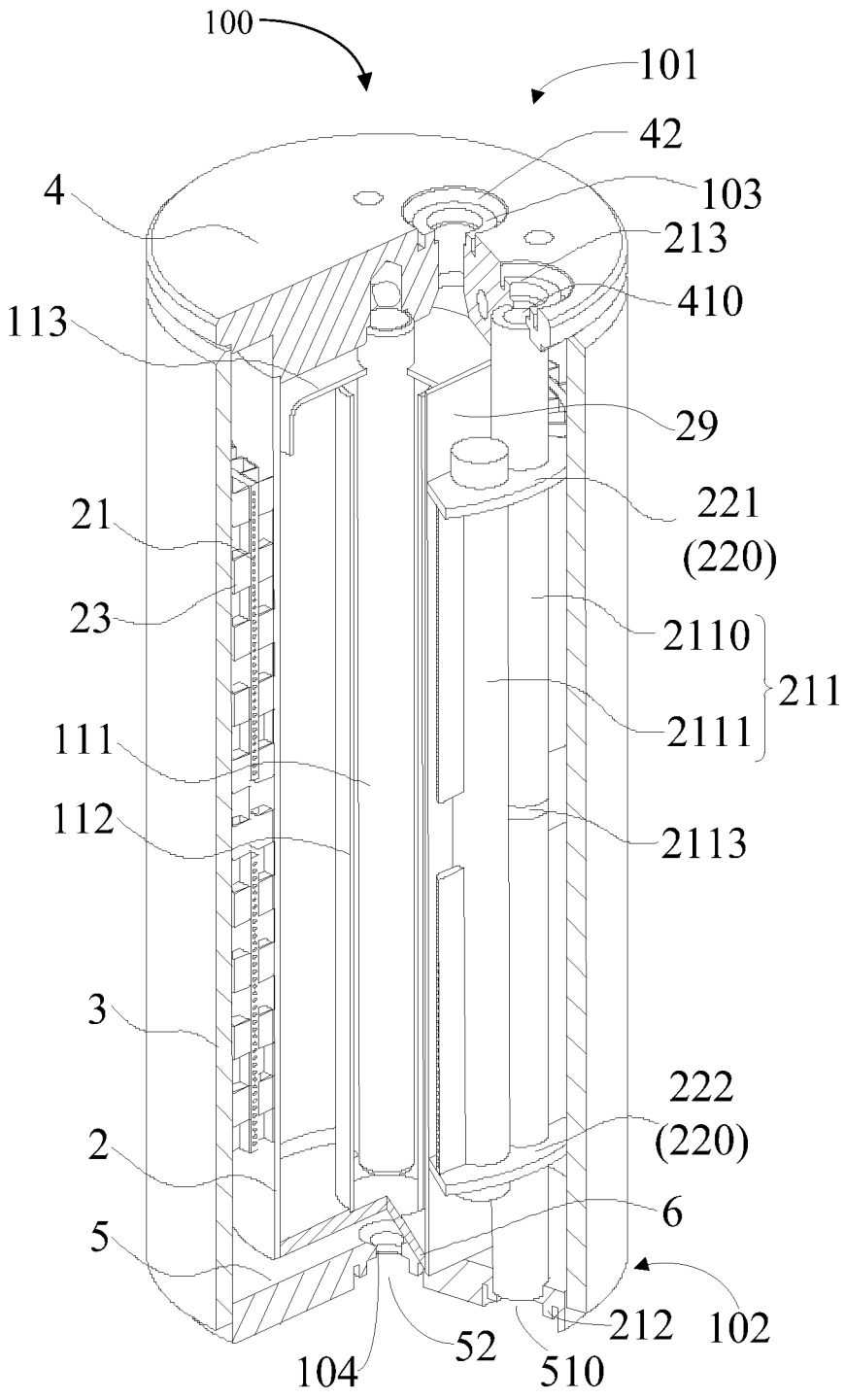
FIG. 28 is a schematic view of a perspective structure of another gas-liquid separator in accordance with an exemplary embodiment of the present application.

In some embodiments, as shown in FIG. 28, the collecting pipes 211 include a first collecting pipe 2110 and a second collecting pipe 2111 which are arranged side by side. One end of the flat tube 21 is inserted into the first collecting pipe 2110, and the other end of the flat tube 21 is inserted into the second collecting pipe 2111. One end of the first collecting pipe 2110 is provided with a first joint 213 to flow the second refrigerant out of the first collecting pipe 2110 or flow the second refrigerant into the first collecting pipe 2110. The other end of the first collecting pipe 2110 is provided with a second joint 212 to correspondingly flow the second refrigerant into the first collecting pipe 2110 or flow the second refrigerant out of the first collecting pipe 2110. Opposite ends of the second collecting pipe 2111 are sealed.

Optionally, as shown in FIGS. 2, 12, 14, 26, 34, 46 and 52, a separator 2113 is provided in the first collecting pipe 2110. The internal space of the first collecting pipe 2110 is separated into two independent first chamber 2115 and second chamber 2116 in order to increase the process of the second refrigerant. Among them, the first chamber 2115 is located below the second chamber 2116. Correspondingly, a part of the flat tube 21 communicates with the first chamber 2115 and an inner space of the second collecting pipe 2111, and the other part of the flat tube 21 communicates with the second chamber 2116 and the inner space of the second collecting pipe 2111.

In some embodiments, as shown in FIGS. 2, 3, 11 and 12, the gas-liquid separator includes a first end cover 4 covering the upper ends of the first cylinder 2 and the second cylinder 3. The first end cover 4 is provided with a first through hole 410 corresponding to the first collecting pipe 2110. During specific installation, at least a part of the first joint 213 is installed in the first through hole 410.

In other embodiments, as shown in FIGS. 1, 13 to 15 and 20, the upper end of the second cylinder 3 is welded to the first end cover 4, and the upper end of the first cylinder 2 abuts against the first end cover 4. Correspondingly, the first end cover 4 is provided with a bend channel 41 communicating with an internal cavity of the collecting pipe 211. The bend channel 41 extends through the upper and lower surfaces of the first end cover 4. The bend channel 41 includes a first opening 4111 on an upper surface of the first end cover 4 and a second opening 4121 on a lower surface of the first end cover 4. Correspondingly, at least a part of the first joint 213 is disposed in the first opening 4111. A central axis of the first opening 4111 and a central axis of the second opening 4121 both extend substantially in a vertical direction, and the central axes are not in a same straight line. The first opening 4111 is arranged closer to a center of the first end cover 4 than the second opening 4121. That is, the first opening 4111 is disposed on an inner side of the first end cover 4 as a whole relative to the second opening 4121, so that the bend channel 41 moves inwardly for a certain distance along a bottom-to-top direction. This is beneficial to the arrangement of the collecting pipe 211, especially the arrangement of an end device of the collecting pipe 211, for example, the arrangement of the first joint 213. In this way, limited by the size of the gas-liquid separator, the first end cover has enough space to install the end device of the collecting pipe, such as the first joint of the collecting pipe etc., thereby making the collecting pipe easy to install and ensure that the pressure resistance strength of the collecting pipe and the flow velocity in the collecting pipe are within a reasonable range.

Figure 14:
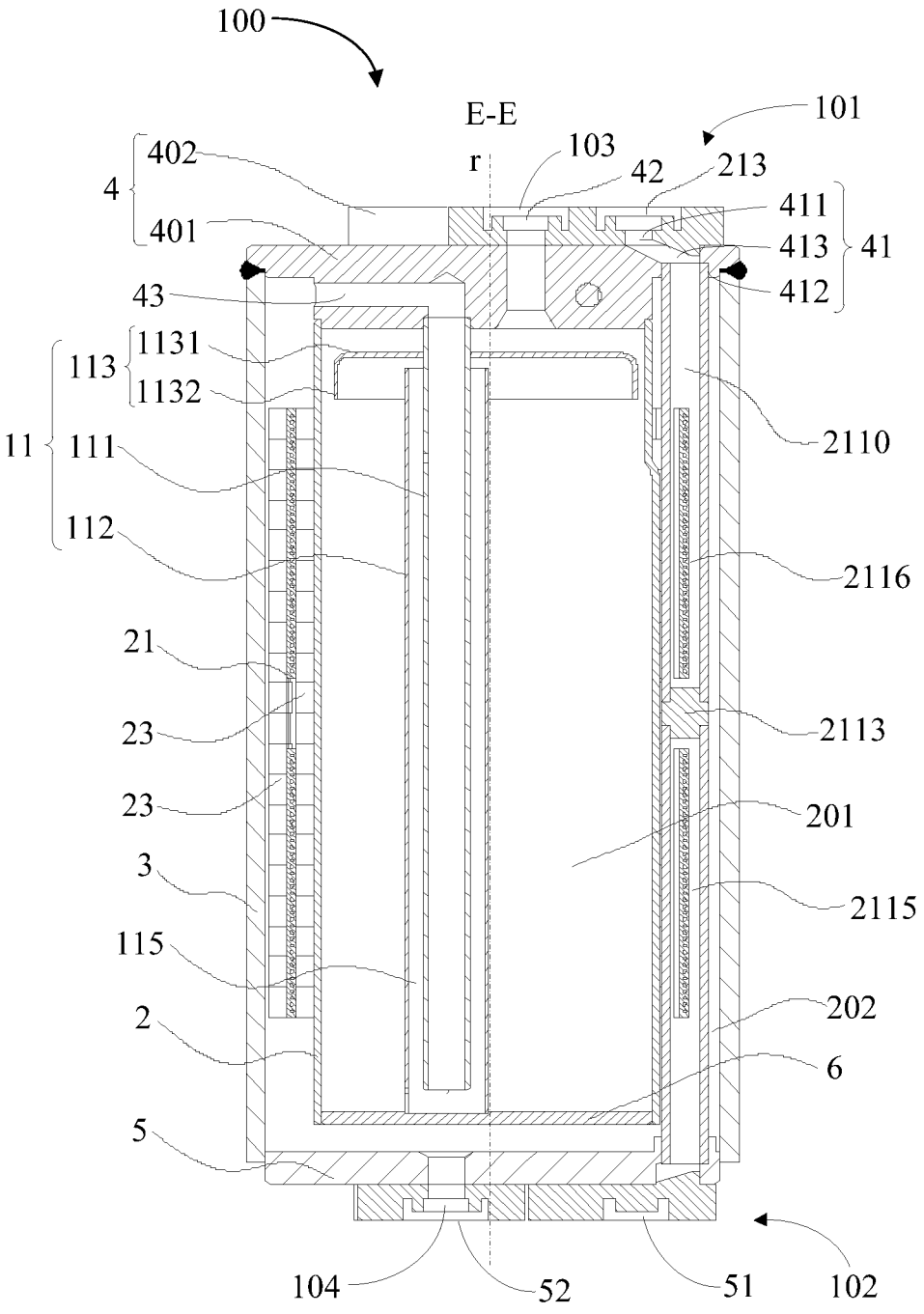
FIG. 14 is a schematic cross-sectional view of the gas-liquid separator taken along a section line E-E shown in FIG. 13.
Figure 20:
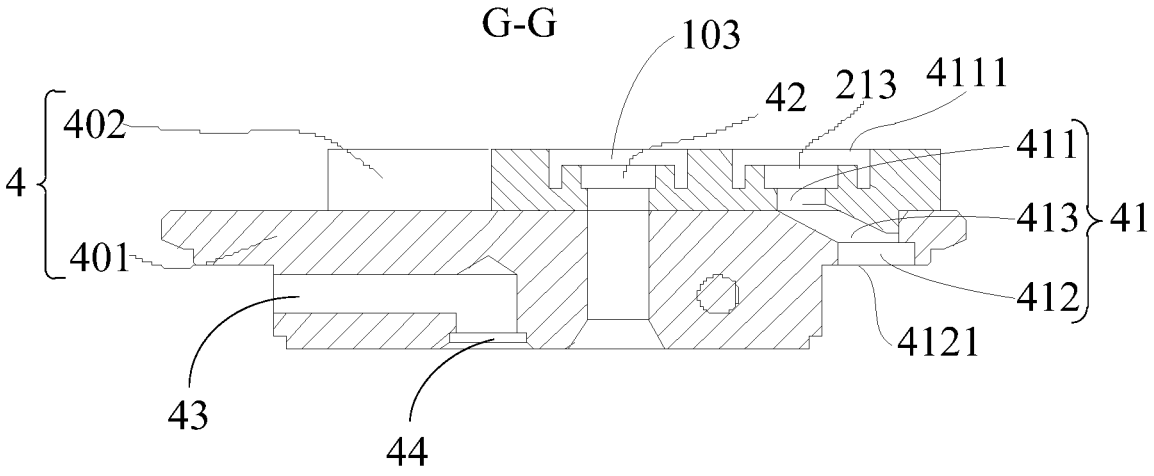
FIG. 20 is a schematic cross-sectional view of the first end cover taken along a section line G-G shown in FIG. 19.
Figure 21:
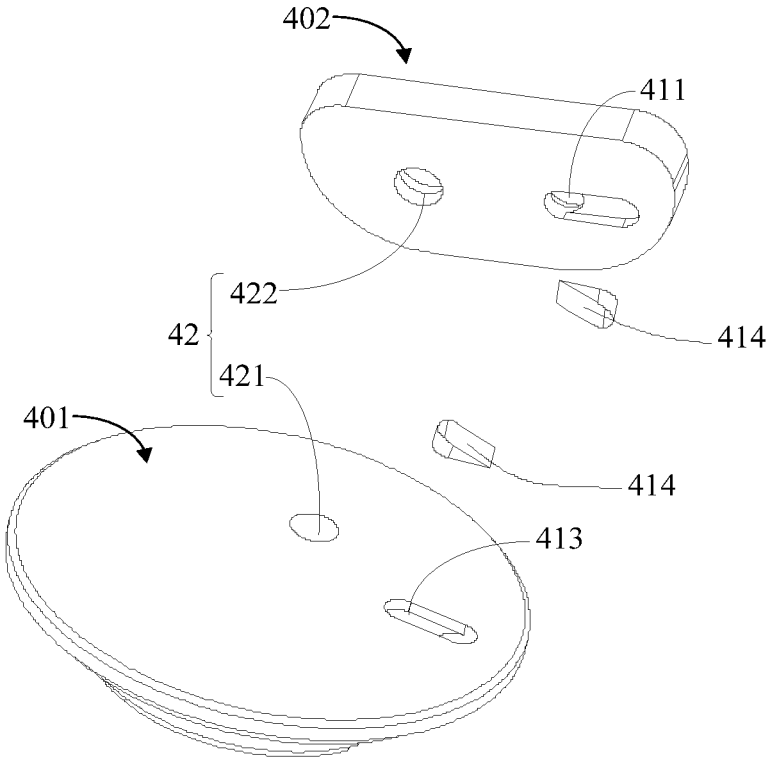
FIG. 21 is an exploded schematic view of another first end cover in accordance with an exemplary embodiment of the present application.
Figure 22:
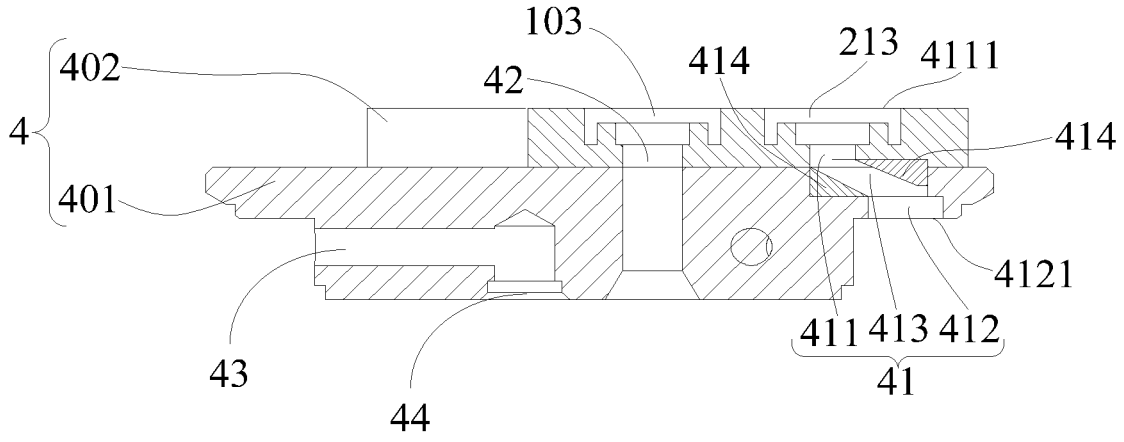
FIG. 22 is a schematic cross-sectional view of the first end cover shown in FIG. 21.
Figure 23:
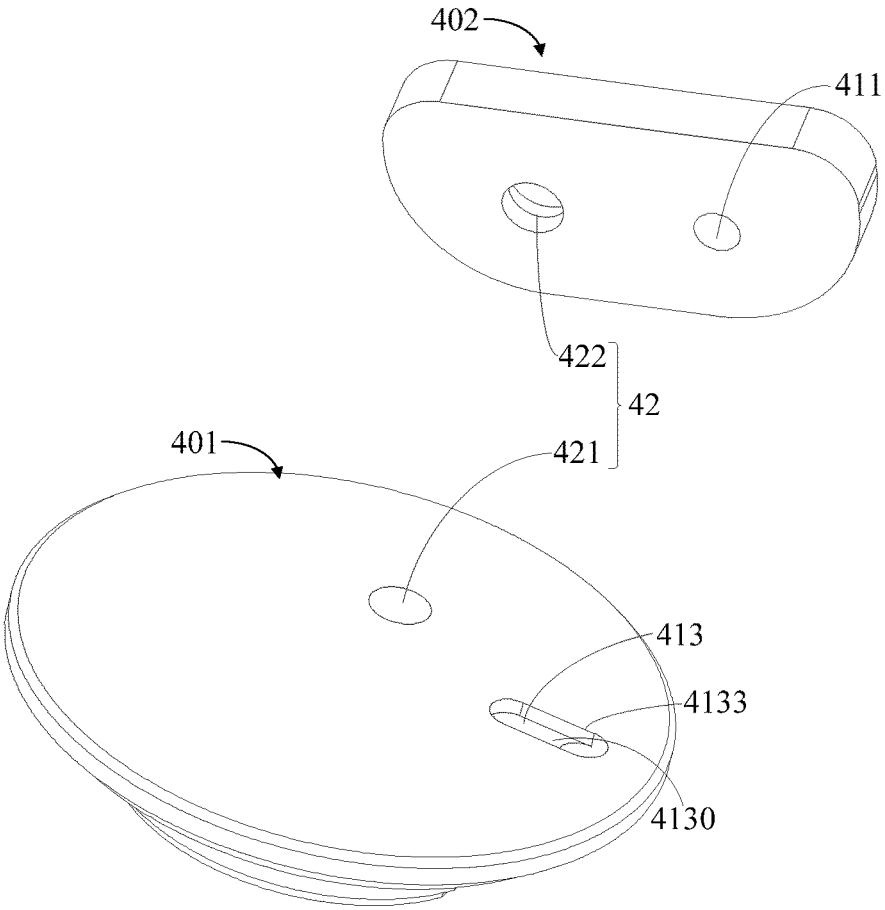
FIG. 23 is an exploded schematic view of another first end cover in accordance with an exemplary embodiment of the present application.
Figure 24:
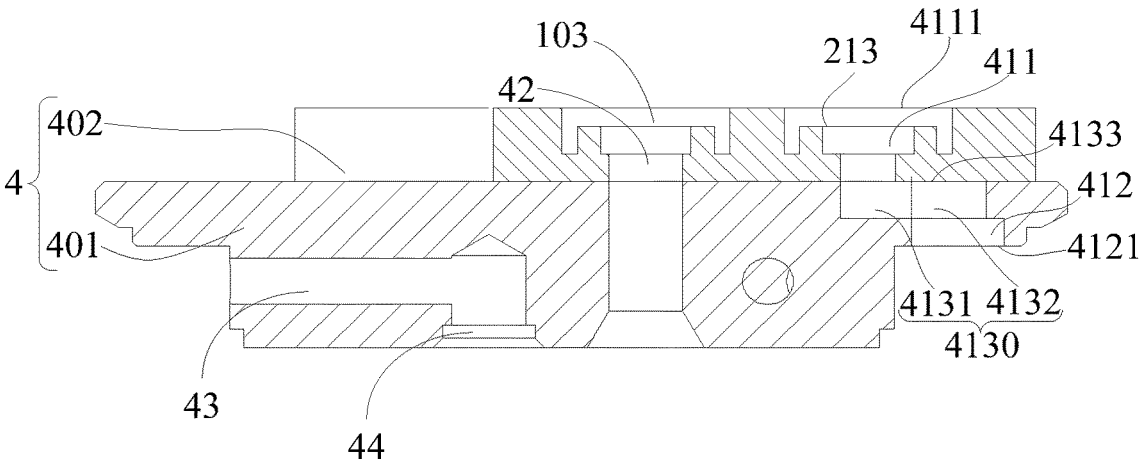
FIG. 24 is a schematic cross-sectional view of the first end cover shown in FIG. 23.

In some embodiments, as shown in FIGS. 14 and 20, the bend channel 41 includes a first section 411 extending vertically and downwardly from the first opening 4111 for a predetermined distance, a second section 412 extending vertically and upwardly from the second opening 4121 for a predetermined distance, and a third section 413 communicating the first section 411 and the second section 412. Correspondingly, the first section 411 and the second section 412 are staggered, and a distance between the first section 411 and a center of the first end cover 4 is smaller than a distance between the second section 412 and the center of the first end cover 4. That is, the first section 411 is closer to the center of the first end cover 4 than the second section 412. Specifically, at least a part of the first joint 213 is disposed at the first section 411.

In some embodiments, as shown in FIGS. 13, 14, and 17 to 24, the first end cover 4 includes a body portion 401 connected to the second cylinder 3 and a pressing cover 402 disposed on a side of the body portion 401 away from the second cylinder 3. The first section 411 extends through upper and lower surfaces of the pressing cover 402. The third section 413 and the second section 412 communicating with each other are provided in the body portion 401. The third section 413 extends through an upper surface of the body portion 401. The second section 412 extends through a lower surface of the body portion. Among them, in some embodiments, the body portion 401 and the pressing cover 402 may be independently provided. Of course, in other embodiments, the body portion 401 and the pressing cover 402 may also be integrally provided.

In some embodiments, the third section 413 is an inclined channel. Take the body portion 401 and the pressing cover 402 as two independent components as an example for description, optionally, in some embodiments, the third section 413 is provided with an inclined step surface 415 on a side close to the center of the first end cover 4. A protrusion 416 extending downwardly is provided on a side of the pressing cover 402 close to the body portion 401. During specific installation, the protrusion 416 at least partially protrudes into the third section 413 and is arranged opposite to the step surface 415. The inclined step surface 415 and/or the inclined surface of the protrusion 416 form an inclined side wall of the inclined channel (referring to FIGS. 17 to 20).

Optionally, in other embodiments, two opposite blocks 414 may be provided in the third section 413. One of the blocks 414 is arranged on a side of the third section 413 close to the center of the first end cover 4, and the other block 414 is arranged on a side of the third section 413 away from the first end cover 4. The inclined surfaces of the two blocks 414 form an inclined side wall of the inclined channel (referring to FIGS. 21 and 22). In some embodiments, the block 414 can be connected with other parts of the first end cover 4 by means of brazing, which facilitates the assembly of the gas-liquid separator 100. The inclined channel is formed by adding the blocks 414, whereby the process is simple and the production is easier.

In some embodiments, the third section 413 includes a strip groove 4130 extending in a radial direction of the first end cover. The strip groove 4130 includes a first groove portion 4131 and a second groove portion 4132. The first groove portion 4131 is closer to the center of the first end cover 4 than the second groove portion 4132. Among them, the first groove portion 4131 communicates with the first section 411 located above the first groove portion 4131. The second groove portion 4132 communicates with the second section 412 located below the second groove portion 4132 (referring to FIGS. 23 and 24). Specifically, the strip groove 4130 includes a strip opening 4133. The strip groove 4130 can be formed by extending a predetermined distance directly below from the strip opening 4133. The strip groove 4130 can be directly milled by a groove milling device, of which the process is simple and easy to operate.

Figure 25:
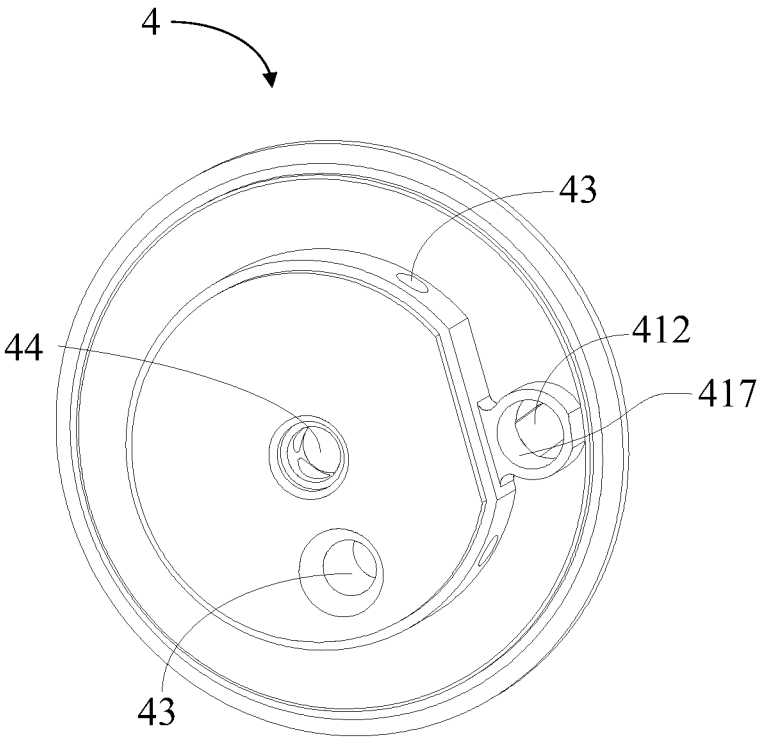
FIG. 25 is a schematic view of another first end cover in accordance with an exemplary embodiment of the present application.

Further, in some embodiments, a welding boss 417 corresponding to the second section 412 is provided below the second section 412 (referring to FIG. 25). The welding boss 417 is approximately ring-shaped, and the upper end of the collecting pipe 211 is disposed in the welding boss 417. The welding boss 417 can be integrally formed with the first end cover 4, or can be set independently. The setting of the welding boss 417 can effectively increase the welding area between the collecting pipe and the first end cover, thereby improving the welding strength, making the gas-liquid separator have a higher burst pressure, such as 40 MPa, and improving the stability of the welding quality.

Figure 15:
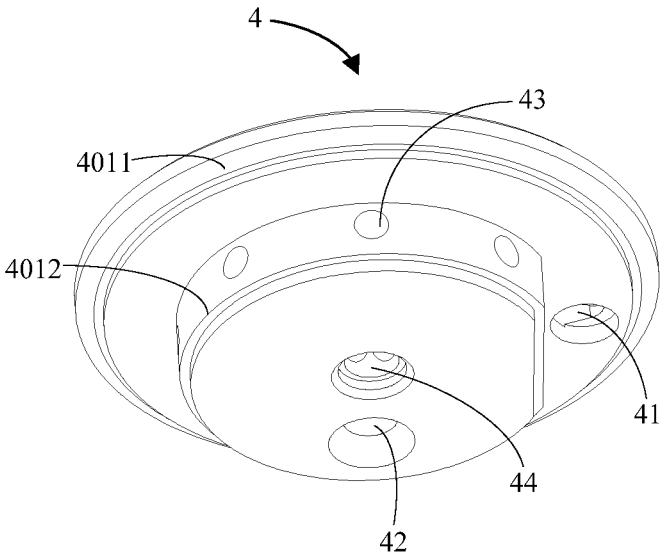
FIG. 15 is a schematic view of a perspective structure of a first end cover in accordance with an exemplary embodiment of the present application.
Figure 16:
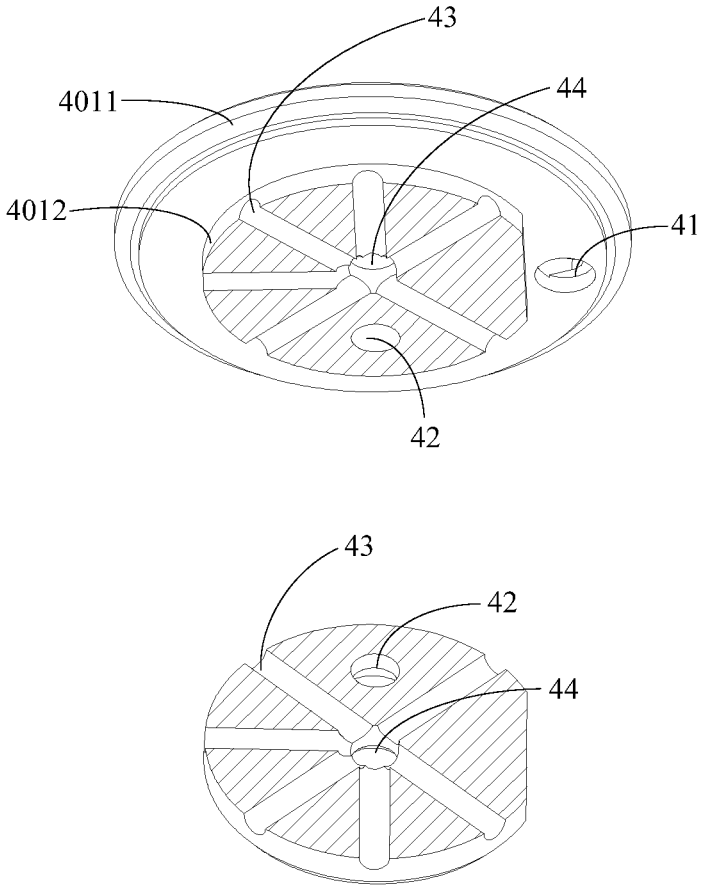
FIG. 16 is a schematic group view of a partial structure of the first end cover shown in FIG. 15.
Figure 17:
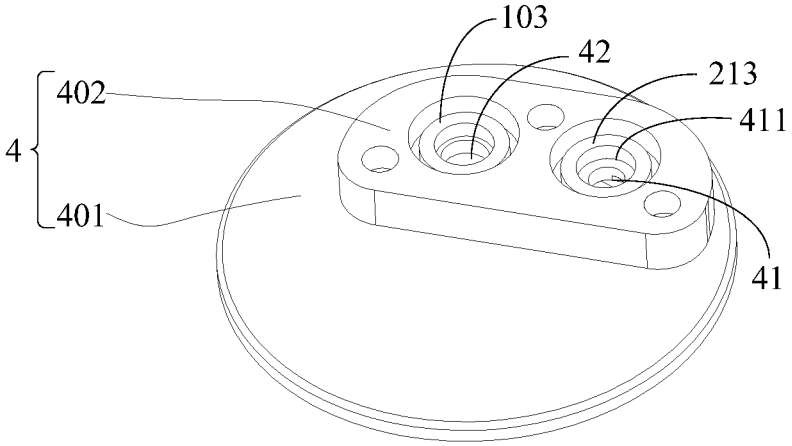
FIG. 17 is a schematic view of a perspective structure of the first end cover shown in FIG. 15 from another perspective.
Figure 18:
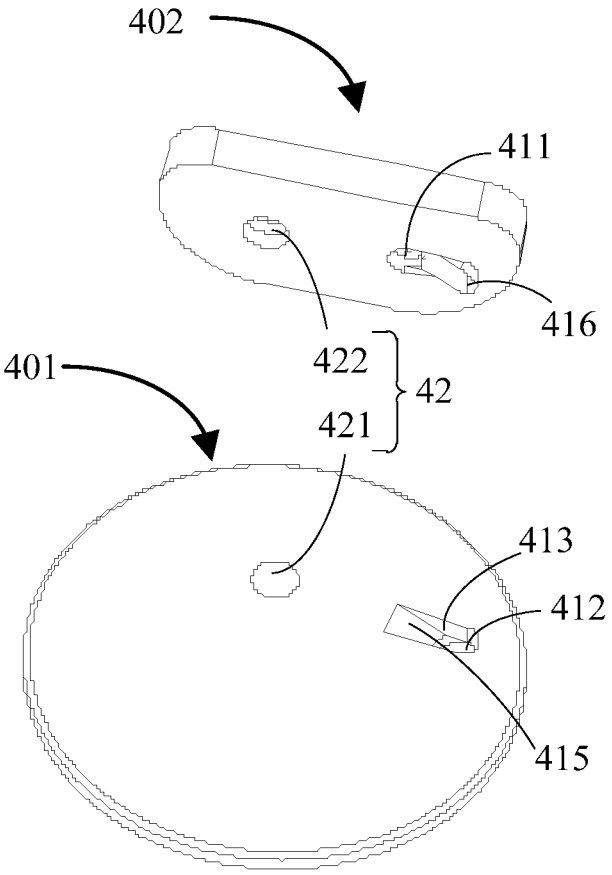
FIG. 18 is an exploded schematic view of another first end cover in accordance with an exemplary embodiment of the present application.
Figure 19:
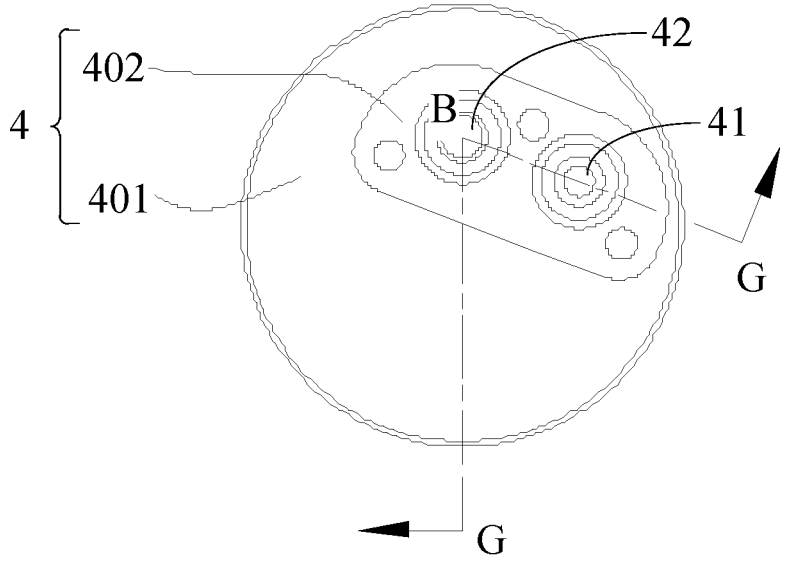
FIG. 19 is a schematic top view of the first end cover shown in FIG. 18.

Specifically, in some embodiments, as shown in FIGS. 15 and 16, an outer contour shape of the body portion 401 of the first end cover 4 is generally of a stepped configuration. The body portion 401 includes a first covering portion 4011 located on an upper location for covering the second cylinder 3, and a second covering portion 4012 extending downwardly from the inner side of the first covering portion 4011 for covering the first cylinder 2. In addition, a side of the second covering portion 4012 adjacent to the bend channel 41 is provided with a notch, for example, a flat portion, so that the body portion 401 has enough space for the second section 412. Correspondingly, the welding boss 417 can be connected to the body portion 401 by welding or the like. Of course, the welding boss 417 can also be integrally formed with the body portion 401. The present application does not limit this, and it can be set according to the specific application environment.

The first end cover 4 is also provided with a first port 42 communicating with the chamber 201. Optionally, the first port 42 may include a first section portion 421 and a second section portion 422 which form the first port 42. Among them, the first section portion 421 is located on the body portion 401 and extends through the upper and lower surfaces of the body portion 401, and the second section portion 422 is located on the pressing cover 402 and extends through the upper and lower surfaces of the pressing cover 402 (referring to FIGS. 18, 21 and 23). In addition, a first connecting pipe 103 may be provided in the first port 42 to flow the first refrigerant into the chamber 201.

In some embodiments, as shown in FIGS. 1, 2, 3, 11 and 12, the gas-liquid separator includes a second end cover 5 covering a lower end of the second cylinder 3. The second end cover 5 is provided with a second through hole 510 corresponding to the first collecting pipe 2110. During specific installation, at least a part of the second joint 212 is installed in the second through hole 510.

In other embodiments, the second end cover 5 is also provided with a bend passage 51 communicating with the lower end of the collecting pipe 211. During specific installation, at least a part of the second joint 212 is installed in an outlet of the bend passage 51 near a lower end thereof.

The second end cover 5 is also provided with a second port 52 communicating with the interlayer space 202. Similarly, a second connecting pipe 104 may also be provided in the second port 52, and the first refrigerant that has undergone heat exchange in the interlayer space 202 can be led out through the second connecting pipe 104.

The second end cover 5 and the inner end cover 6 are separated by a predetermined distance. Correspondingly, the second port 52 can be arranged at a center of the second end cover 5 or adjacent to the center of the second end cover 5. Of course, the second port 52 can also be arranged in other positions of the second end cover 5, which is not limited in the present application and it can be set according to specific application environment. Correspondingly, the second port 52 is an outlet of the interlayer space 202, which can be used as an outlet of the first refrigerant.

Figure 2:
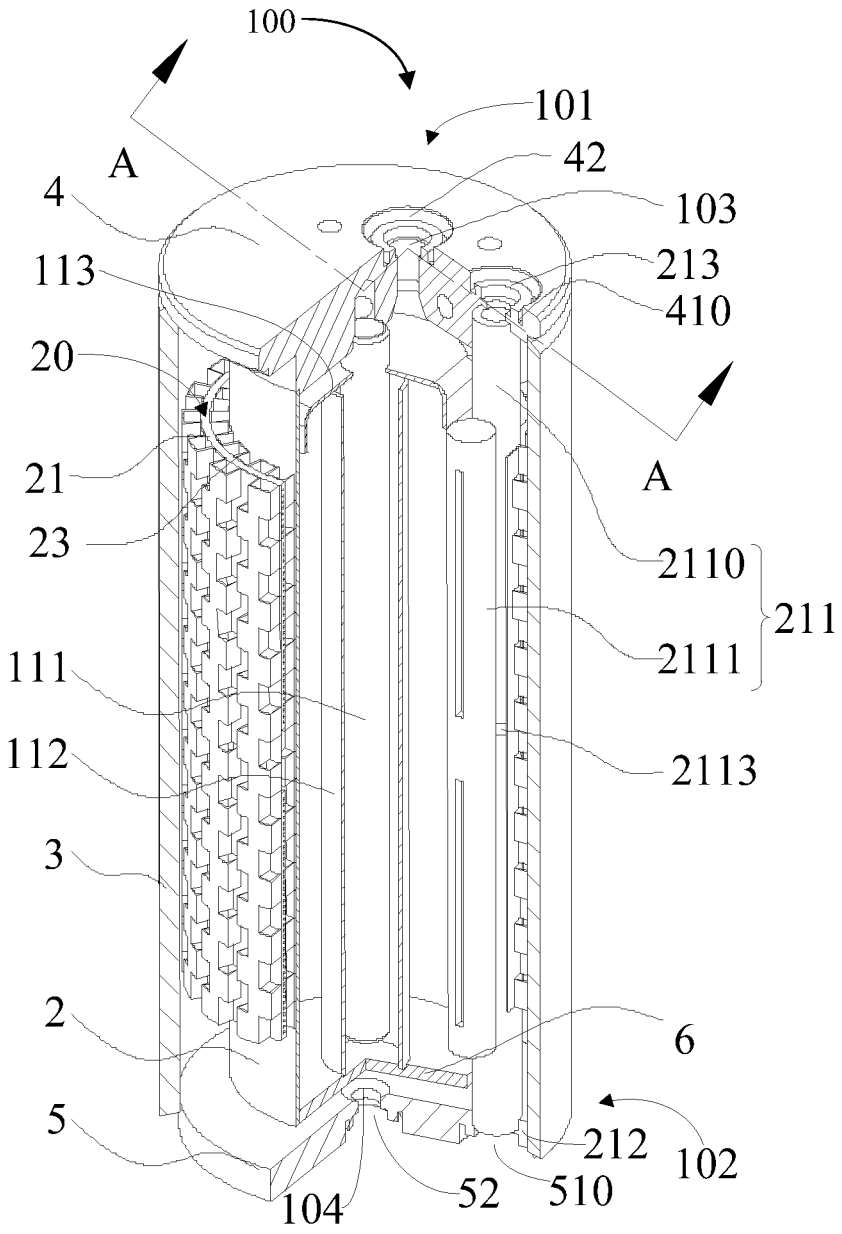
FIG. 2 is a schematic view of a perspective structure of another gas-liquid separator in accordance with an exemplary embodiment of the present application.
Figure 3:
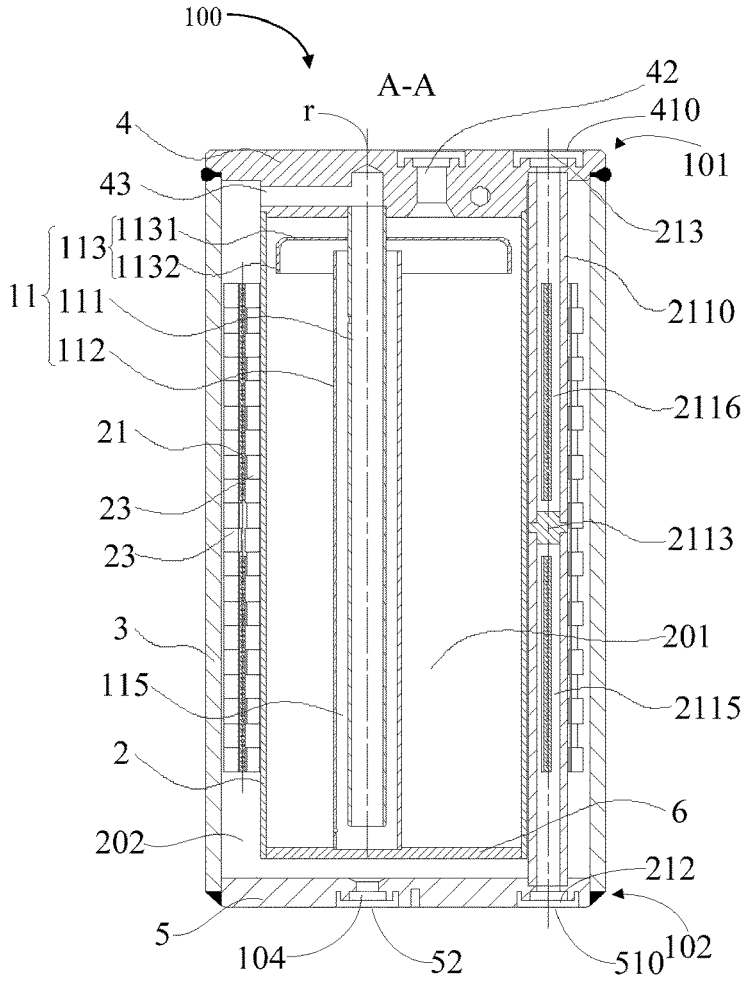
FIG. 3 is a schematic cross-sectional view of the gas-liquid separator taken along a section line A-A shown in FIG. 2.

Further, in some embodiments, as shown in FIGS. 3 to 8B, the avoidance portion 29 extends from one end of the first cylinder 2 to the other end of the first cylinder 2 in a direction parallel to the axial direction of the first cylinder 2. Compared with a gas-liquid separator without the avoidance portion 29, an arrangement position of the collecting pipe is offset close to the axis r of the first cylinder (as shown in FIG. 3). That is, a distance between the collecting pipe and the axis r of the first cylinder (as shown in FIG. 3) becomes smaller. Correspondingly, as shown in FIGS. 2 and 3, a distance between the first through hole 410 and the center of the first end cover 4 is also smaller, so that the first end cover 4 has enough space for the first joint 213. Moreover, under the condition that the overall size of the gas-liquid separator remains unchanged, at least a part of the collecting pipe is provided between the avoidance portion and the second cylinder. For example, the collecting pipe with an increased pipe diameter can be arranged corresponding to the avoidance portion, thereby ensuring the pressure resistance strength of the collecting pipe. In the same way, the second end cover 5 has enough space to install the second joint 212.

An offset distance of the collecting pipe to the axis r of the first cylinder is related to the size of the avoidance portion 29 (i.e., a depth of the recess). During specific implementation, the size of the avoidance portion 29 can be adjusted to suit the installation of different sizes of collecting pipes and joints (including the first joint and the second joint).

Both ends of the avoidance portion 29 can be provided with openings to facilitate the installation of the collecting pipe. For example, taking the first cylinder 2 shown in FIG. 4A as an example, an opening 2911 is provided at an upper end of the avoidance portion 29, and an opening 2912 is provided at a lower end of the avoidance portion 29. This arrangement is applicable to an embodiment in which the first joint 213 and the second joint 212 are respectively arranged at both ends of the gas-liquid separator 100.

Figure 6:
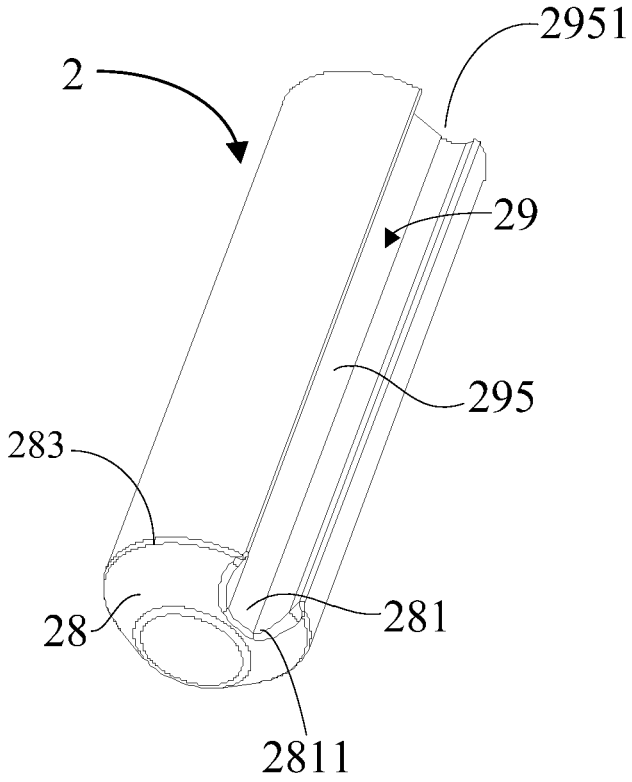
FIG. 6 is a schematic view of a perspective structure of the first cylinder of the gas-liquid separator in another exemplary embodiment of the present application.

In some embodiments, the upper end of the first cylinder 2 is open, and the lower end is provided with a blocking portion 28 that closes the first cylinder 2. For example, a portion where the lower end of the first cylinder 2 and the blocking portion 28 are connected is formed as an edge 283. For example, as shown in FIG. 6, the avoidance portion 29 includes a first avoidance portion 295 extending from the open upper end of the first cylinder 2 to the lower end of the first cylinder 2 or the edge 283 along the axial direction r parallel to the first cylinder 2. The avoidance portion 29 also includes a second avoidance portion 281 located in the blocking portion 28 and corresponding to the first avoidance portion 295. The second avoidance portion 281 may be in alignment with the first avoidance portion 295. Correspondingly, the upper end of the avoidance portion 29 is provided with an opening 2951, and the lower end of the avoidance portion 29 is provided with an opening 2811.

Figure 7:
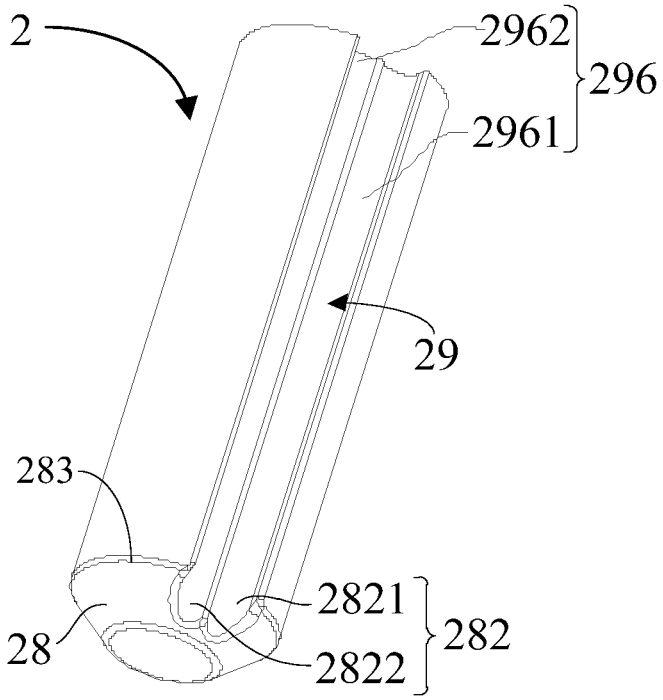
FIG. 7 is a schematic view of a perspective structure of the first cylinder of the gas-liquid separator in another exemplary embodiment of the present application.

For another example, as shown in FIG. 7, the avoidance portion 29 includes a first avoidance portion 296 extending from the open upper end of the first cylinder 2 to the lower end of the first cylinder 2 or the edge 283 along the axial direction r parallel to the first cylinder 2. The avoidance portion 29 also includes a second avoidance portion 282 located in the blocking portion 28 and corresponding to the first avoidance portion 296. The second avoidance portion 282 may be in alignment with the first avoidance portion 296.

The second avoidance portion 281 and the first avoidance portion 295 may also include aligned planes, which is not limited in the present application, and it may be set according to specific application environment. It should be noted that in some embodiments, the blocking portion 28 can be understood as the inner end cover 6.

Of course, the avoidance portion 29 may be open at one end and closed at the other end. This arrangement is applicable to an embodiment in which both the first joint 213 and the second joint 212 are arranged at the first end 101. This application does not limit this, and it can be set according to the specific application environment.

In some embodiments, the avoidance portion 29 includes a groove extending in a direction parallel to the axial direction r of the first cylinder 2.

Figure 4A:
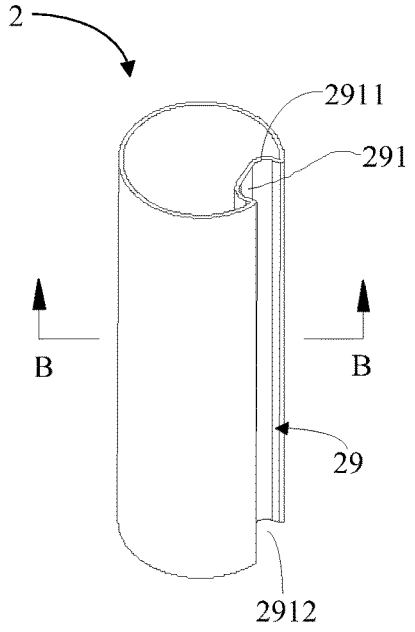
FIG. 4A is a schematic view of a perspective structure of a first cylinder of the gas-liquid separator in an exemplary embodiment of the present application.
Figure 4B:
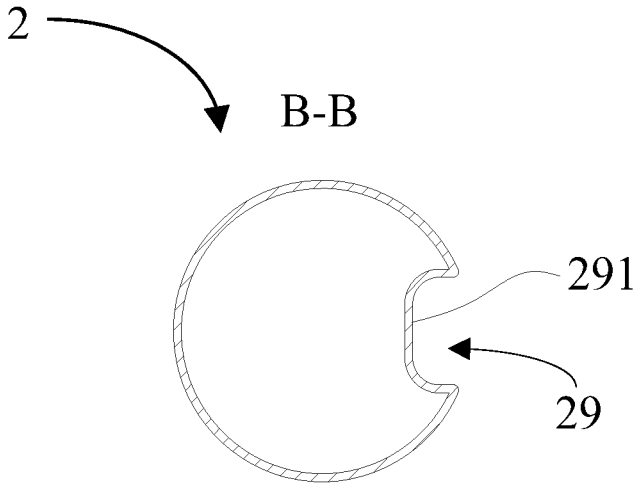
FIG. 4B is a cross-sectional view of the first cylinder taken along a section line B-B shown in FIG. 4A.
Figure 4C:
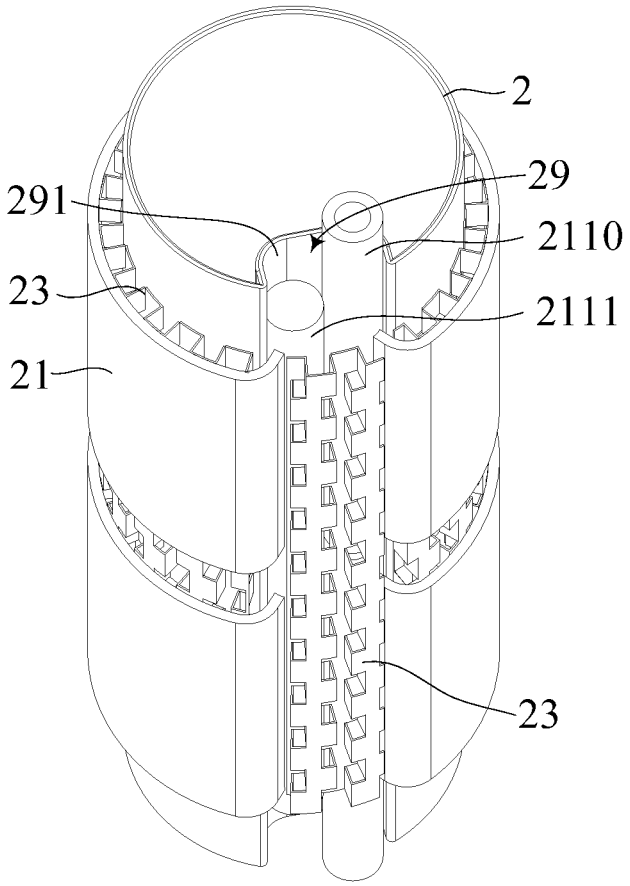
FIG. 4C is a schematic view of an assembled structure of the first cylinder and a heat exchange assembly shown in FIG. 4A.

For example, as shown in FIGS. 4A and 4B, the avoidance portion 29 may include a first groove 291. Taking the collecting pipe 211 including the first collecting pipe 2110 and the second collecting pipe 2111 arranged in parallel as an example, the aforementioned collecting pipe 211 is provided corresponding to the avoidance portion 29. That is, it can be understood that the first collecting pipe 2110 and the second collecting pipe 2111 may be partially or completely disposed in the first groove 291. Compared with a gas-liquid separator without the avoidance portion 29, a distance between the first collecting pipe 2110 and the axis r of the first cylinder 2 and a distance between the second collecting pipe 2111 and the axis r of the first cylinder 2 are smaller. Correspondingly, a distance between the first through hole 410 and the center of the first end cover 4 is also smaller, and a distance between the second through hole 510 and the center of the second end cover 5 is also smaller, or the bend channels of the first end cover and the second end cover move inwardly a certain distance along the bottom-to-top direction (as shown in FIGS. 13 to 15 and FIG. 20). In this way, the first end cover 4 has enough space for the first joint 213 and the second end cover 5 has enough space for the second joint 212, which facilitates the installation of the first joint 213 and the second joint 212.

Figure 5A:
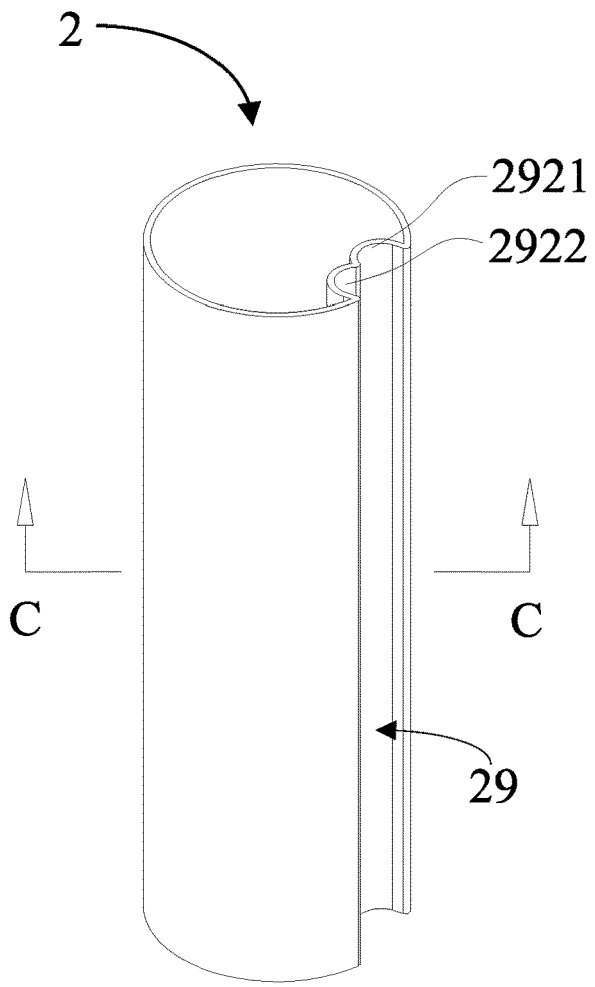
FIG. 5A is a schematic view of a perspective structure of the first cylinder of the gas-liquid separator in another exemplary embodiment of the present application.
Figure 5B:
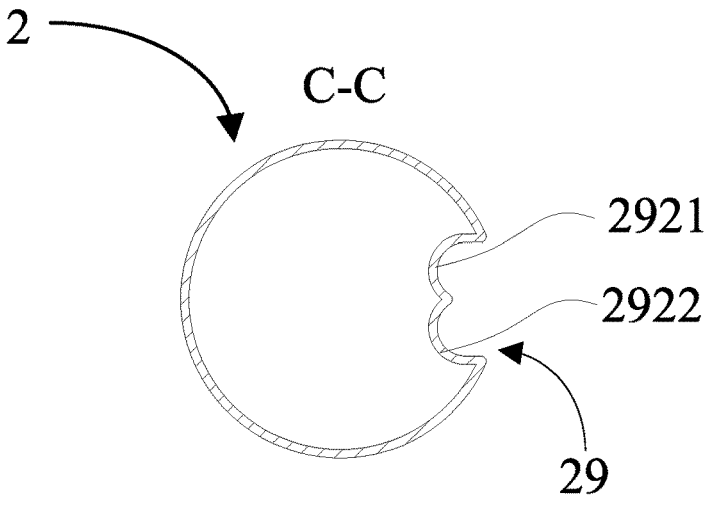
FIG. 5B is a cross-sectional view of the first cylinder taken along a section line C-C shown in FIG. 5A.

Alternatively, as shown in FIGS. 5A and 5B, the avoidance portion 29 may include a second groove 2921 and a third groove 2922 which are adjacent to each other. In addition, the second groove 2921 and the third groove 2922 have a common rib. Similarly, taking the collecting pipe 211 including the first collecting pipe 2110 and the second collecting pipe 2111 arranged in parallel as an example, the aforementioned collecting pipe 211 is disposed corresponding to the avoidance portion 29. That is, it can be understood that at least a part of the first collecting pipe 2110 can be disposed in the second groove 2921, and at least a part of the second collecting pipe 2111 can be disposed in the third groove 2922. That is, the second groove 2921 corresponds to the first collecting pipe 2110, and the third groove 2922 may correspond to the second collecting pipe 2111. In this way, it is beneficial to ensure the volume of the chamber 201. It should be noted that the depth and degree of curvature of the second groove 2921 and the third groove 2922 can be set corresponding to pipe diameters of the first collecting pipe 2110 and the second collecting pipe 2111.

Correspondingly, in the embodiment shown in FIG. 7, the first avoidance portion 296 includes a groove 2961 and a groove 2962 which are arranged adjacently with each other. The second avoidance portion 282 includes a groove 2821 corresponding to the groove 2961 and a groove 2822 corresponding to the groove 2962.

It should be noted that the groove included in the avoidance portion 29 may also have other curved shapes. The present application does not limit this, and it can be set according to the specific application environment.

Figure 8A:
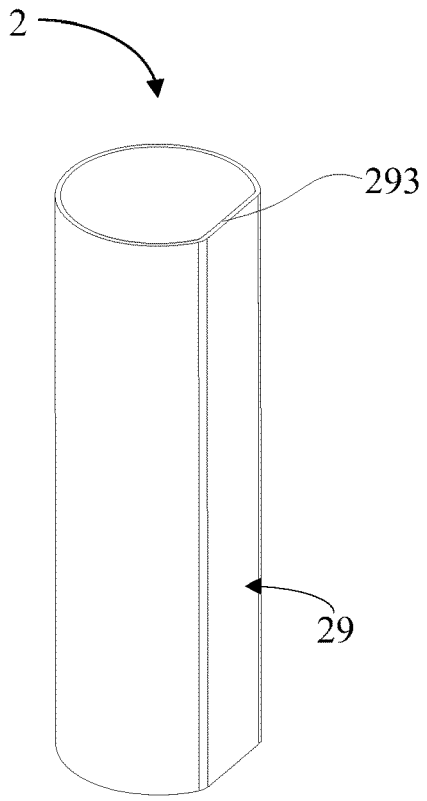
FIG. 8A is a schematic view of a perspective structure of the first cylinder of the gas-liquid separator in another exemplary embodiment of the present application.
Figure 8B:
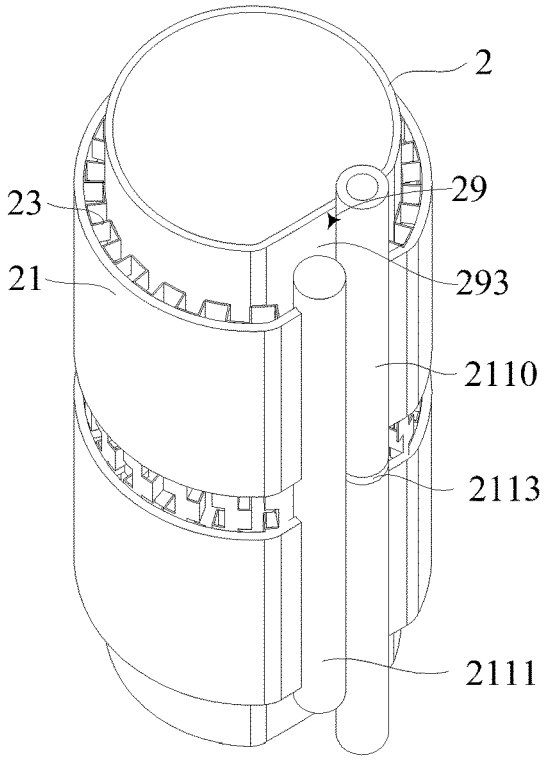
FIG. 8B is a schematic view of the assembly structure of the first cylinder and the heat exchange assembly shown in FIG. 8A.

Optionally, as shown in FIGS. 8A and 8B, the avoidance portion 29 includes a first straight wall 293 extending in a direction parallel to the axial direction r of the first cylinder 2. Therefore, the aforementioned collecting pipe 211 is provided corresponding to the avoidance portion 29, which can be understood as the collecting pipe 211 being provided adjacent to the first straight wall 293. The collecting pipe 211 may be or not be attached to the first straight wall 293.

Figure 9:
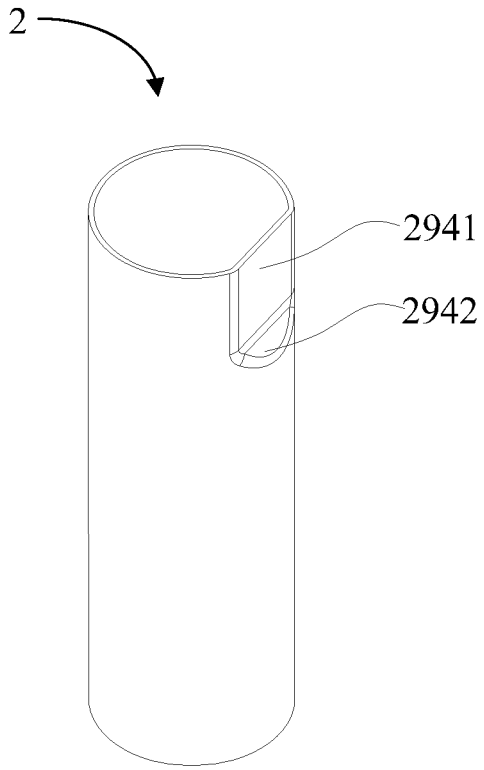
FIG. 9 is a schematic view of a perspective structure of the first cylinder of the gas-liquid separator in another exemplary embodiment of the present application.

In other embodiments, as shown in FIG. 9, the avoidance portion 29 may include a first plane 2941 formed by extending a certain distance (for example, a preset distance) from the upper end to the lower end of the first cylinder 2, and a slope surface 2942 connecting a lower end of the first plane 2941 (referring to FIG. 9). Of course, in some other embodiments, the first plane can also be replaced by an arc-shaped concave surface so as to form a groove accordingly. Compared with a gas-liquid separator without the avoidance portion 29, a sufficient space can be reserved at the position of the first end cover 4 corresponding to the avoidance portion 29 in order to provide the first through hole 410 or the bend channel 41 with a relatively large diameter, thereby facilitating the installation of the first joint. The aforementioned collecting pipe 211 is provided corresponding to the avoidance portion 29, which can be understood as being provided adjacent to the first plane 2941 and the slope surface 2942.

Figure 10:
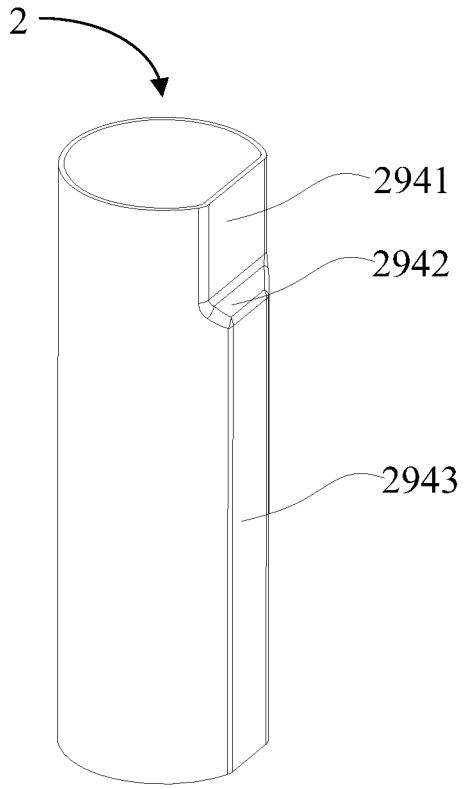
FIG. 10 is a schematic view of a perspective structure of the first cylinder of the gas-liquid separator in another exemplary embodiment of the present application.

In other embodiments, in addition to the first plane 2941 and the slope surface 2942 described above, the avoidance portion 29 may also include a second plane 2943 extending downwardly from the lower end of the slope surface 2942 (referring to FIG. 10). The second plane 2943 may be a straight wall surface. Of course, in some other embodiments, the second plane 2943 can also be replaced by an arc-shaped concave surface in order to form a groove accordingly.

Furthermore, a heat dissipation member 23 is provided in the interlayer space 202 to enhance heat exchange. In some embodiments, a side of the flat tube 21 facing the outer wall surface of the first cylinder 2 and a side of the flat tube 21 facing the inner wall surface of the second cylinder 3 are both provided with the heat dissipation members 23. That is, the heat dissipation members 23 are provided on both sides of the flat tube 21. Among them, the heat dissipation members 23 can be brazed to the outer wall surface of the first cylinder 2 and the inner wall surface of the second cylinder 3, respectively; or can be brazed to both sides of the flat tube 21, respectively. Of course, the heat dissipation member can also be provided only on one side of the flat tube. Among them, the heat dissipation member can be brazed to the outer wall of the first cylinder, or the heat dissipation member is brazed to the inner wall of the second cylinder, or the heat dissipation member is brazed to one of the two sides of the flat tube. Of course, the heat dissipation member 23 can also be arranged in other ways, or it can only be in contact with the outer wall surface of the first cylinder, or the inner wall surface of the second cylinder, or the outer wall of the flat tube 21. This application does not limit the number and the setting method of the heat dissipation member, which can be set according to the specific application environment.

As shown in FIGS. 29A, 33, 36 and 38, the heat exchange assembly 20 includes a first heat dissipation member 231 disposed on a side of the flat tube 21 facing the outer wall of the first cylinder 2, and a second heat dissipation member 232 disposed on a side facing the inner wall of the second cylinder 3. In the present application, unless otherwise specified, the first heat dissipation member 231 and the second heat dissipation member 232 may be collectively referred to as the heat dissipation member 23.

In this embodiment, the heat dissipation member 23 is formed by connecting a plurality of flake units substantially in the shape of "几" in order to increase the heat dissipation area. The protrusions of any two adjacent columns or rows in the "几"-shaped flake units are arranged in staggered manner. This effectively increases the disturbance to the heat exchange refrigerant, and at the same time increases the resistance of the first refrigerant to flow to the second cavity 2022 as described below.

As shown in FIGS. 28 and 29, a baffle 220 is sleeved on the outside of the collecting pipe 211 in order to prevent the refrigerant from directly flowing out of the interlayer space 202 via a space outside the collecting pipe 211. That is, the baffle 220 is configured to allow the refrigerant to flow through the heat dissipation member 23 while blocking the refrigerant from flowing out through a space formed by the collecting pipe 211, an outer wall of the first cylinder 2 and an inner wall of the second cylinder 3. In this way, compared with the collecting pipe with no baffle arranged outside thereof, the baffle in this embodiment can prevent the outside of the collecting pipe from forming a bypass channel that facilitates the circulation of refrigerant, thereby improving the heat exchange efficiency of the gas-liquid separator.

The baffle may be or not be connected to the heat dissipation member 23. This application does not limit this, and it can be set according to the specific application environment.

Figure 32:
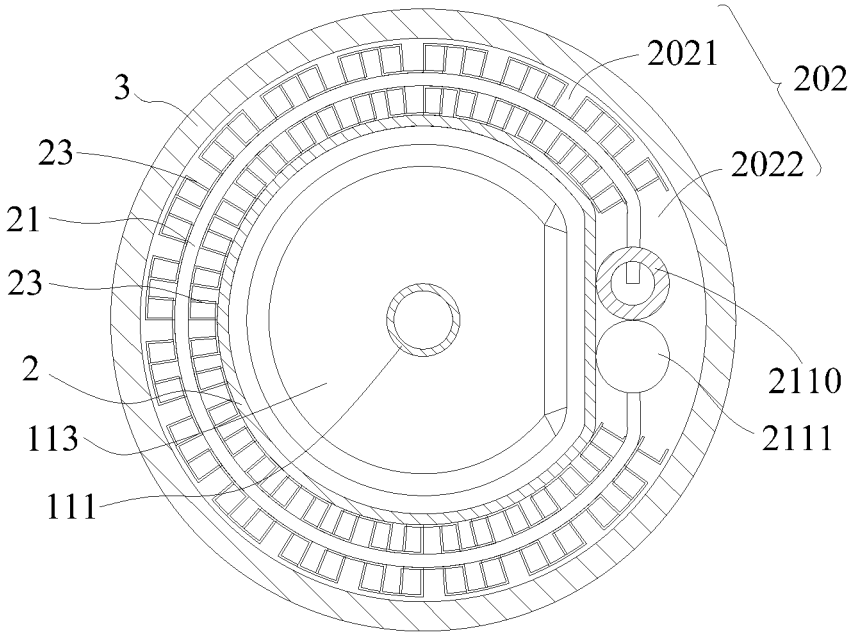
FIG. 32 is a schematic structural view of an exemplary embodiment of the present application with the baffle removed.

In some embodiments, the baffle 220 includes a first baffle 221 connected to the upper end of the heat dissipation member 23 (referring to FIGS. 29A, 29B and 29C) so as to prevent part of the first refrigerant entering the interlayer space from directly passing through the space outside of the collecting pipe 211. For example, the space can be a space formed by the collecting pipe 211, the out wall of the first cylinder 2 and the inner wall of the second cylinder 3. The first refrigerant flows to a lower end and then flows out of the interlayer space. In other words, the first refrigerant is allowed to flow through the outside of the heat dissipation member 23 and the flat tube 21 to the maximum, thereby helping to improve the heat exchange efficiency of the gas-liquid separator 100. Specifically, the interlayer space 202 can be understood as including a first cavity 2021 for arranging the flat tube and the heat dissipation member 23, and a second cavity 2022 for accommodating the collecting pipe 211 (referring to FIG. 32). Then, the first cavity 2021 is a passage for the first refrigerant. The aforementioned avoidance portion 29 can be understood as a part of the first cylinder 2 for forming the second cavity 2022. Moreover, the arrangement of the first baffle 221 can prevent the first refrigerant from entering the second cavity 2022, thereby the heat exchange efficiency of the heat exchange assembly is improved.

During specific installation, the connection between the first baffle 221 and the heat dissipation member 23 may partially overlap. A lower end surface of the first baffle 221 is connected to an upper end of the heat dissipation member 23. In some embodiments, a height of the heat dissipation member 23 and a height of the flat tube 21 are substantially the same. That is, upper ends of the heat dissipation member 23 and the flat tube 21 are substantially flush, and lower ends of the heat dissipation member 23 and the flat tube 21 are also substantially flush. The lower end surface of the baffle 221 can be connected with the upper end surface of the flat tube 21. Of course, the first baffle 221 can also just abut against the heat dissipation member 23 without overlapping with the heat dissipation member 23. Optionally, the first baffle 221 can also be arranged slightly downwards, for example, the first baffle 221 is connected to an upper half of the heat dissipation member 23.

Figure 31:
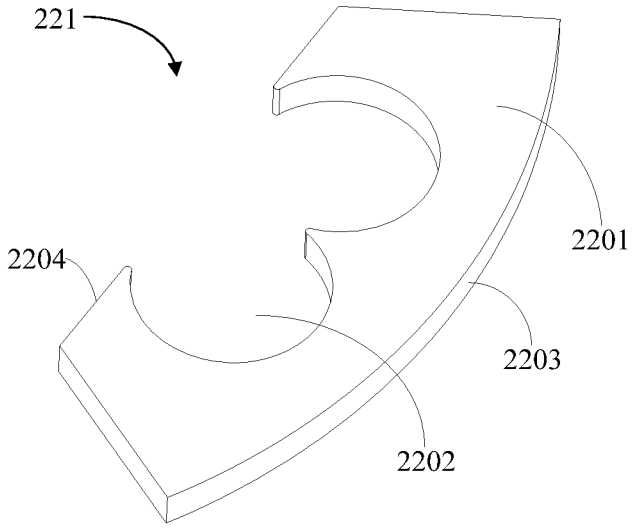
FIG. 31 is a schematic structural view of a baffle of an exemplary embodiment of the present application.

As shown in FIG. 31, the first baffle 221 includes a baffle main body 2201 and a mounting hole 2202 for receiving the collecting pipe 211. In some embodiments, the mounting hole 2202 can be attached to the outer wall of the collecting pipe 211. The specific shape of the mounting hole 2202 can be determined according to the cross-sectional shape of the outer wall of the collecting pipe, which is not limited in this application. Of course, if there is a narrow gap between the mounting hole and the outer wall of the collecting pipe due to the production process etc., this has little effect on the flow of the first refrigerant, thereby it should be understood that it is also within the protection scope of this application.

The first baffle 221 has an outer side surface 2203 attached to the inner wall surface of the second cylinder 3 and an inner side surface 2204 attached to the outer wall of the first cylinder 2. In some embodiments, the outer side surface 2203 is an arc-shaped curved surface which can be closely attached to the second cylinder 3 to further improve the shielding effect of the first baffle 221, thereby further improving the heat exchange efficiency of the gas-liquid separator.

Figure 29A:
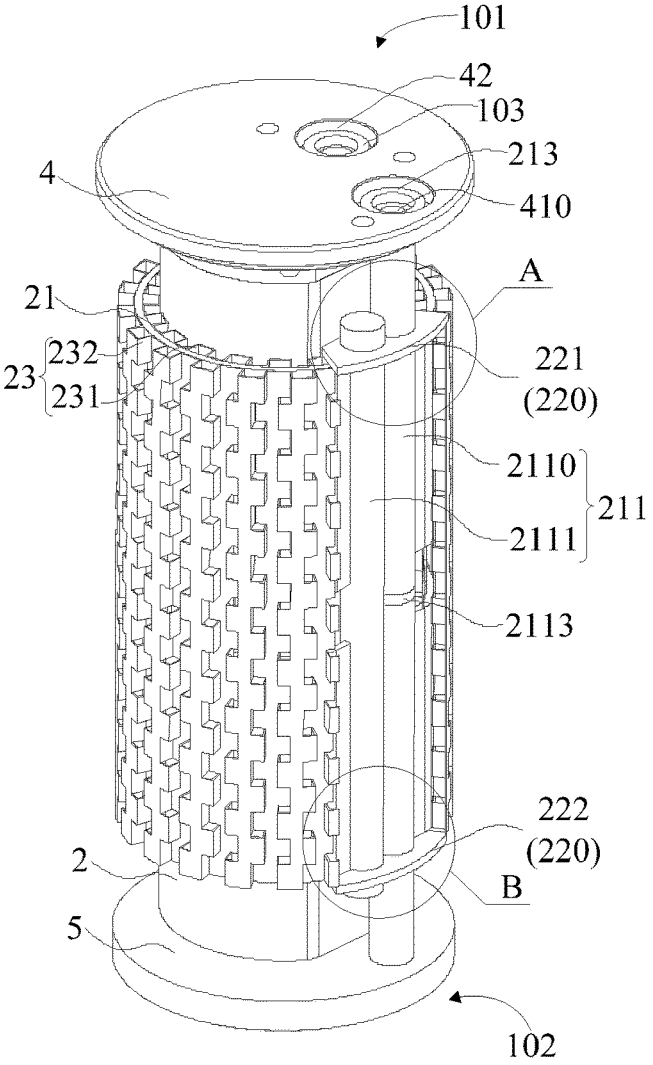
FIG. 29A is a schematic view of a perspective structure of the gas-liquid separator shown in FIG. 28 with a second cylinder removed.
Figure 29B:
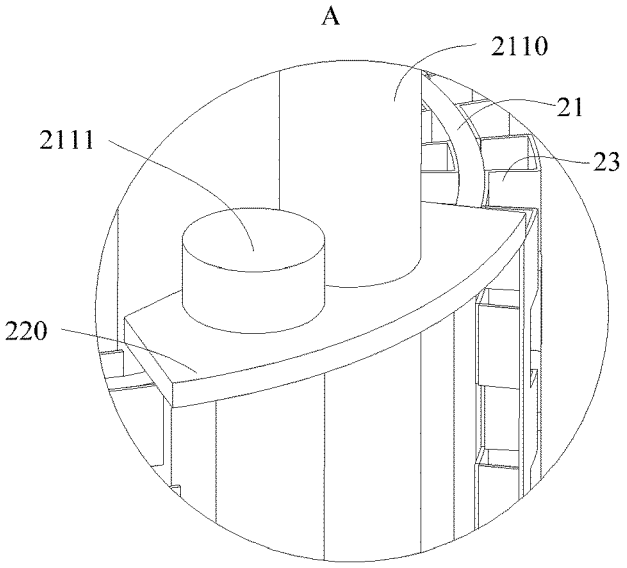
FIG. 29B is an enlarged schematic view of part A of the gas-liquid separator shown in FIG. 29A.
Figure 29C:
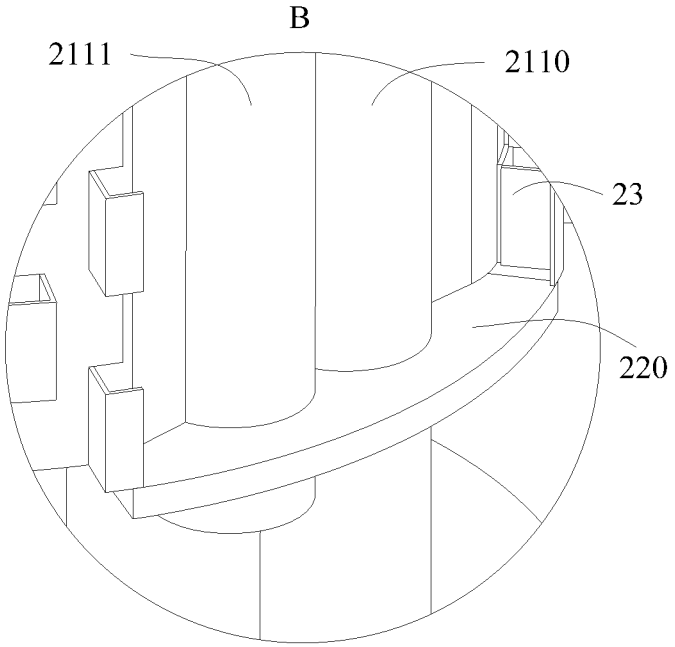
FIG. 29C is an enlarged schematic view of part B of the gas-liquid separator shown in FIG. 29A.
Figure 30:
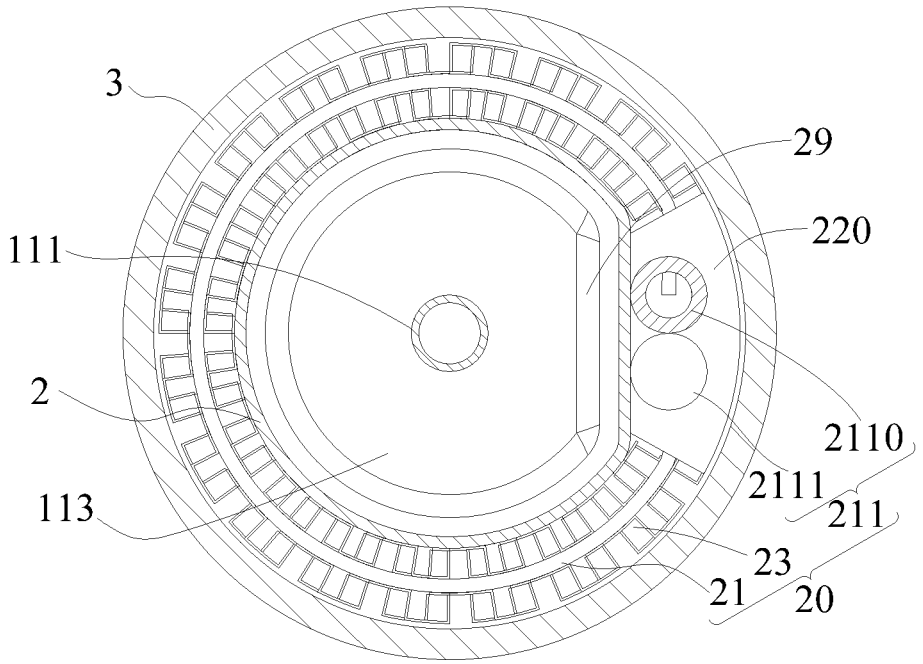
FIG. 30 is a top view of the gas-liquid separator shown in FIG. 28.

Optionally, in addition to the first baffle 221 sleeved on the outside of the collecting pipe 211, the collecting pipe 211 is also sleeved by a second baffle 222 connected to a lower end of the heat dissipation member 23, as shown in FIGS. 28 and 29A. The structure of the second baffle 222 may be substantially the same as the structure of the first baffle 221. In addition, the arrangement of the second baffle 222 may be the same as the arrangement of the first baffle 221, and reference may be made to the above related description, which will not be repeated here.

Figure 33:
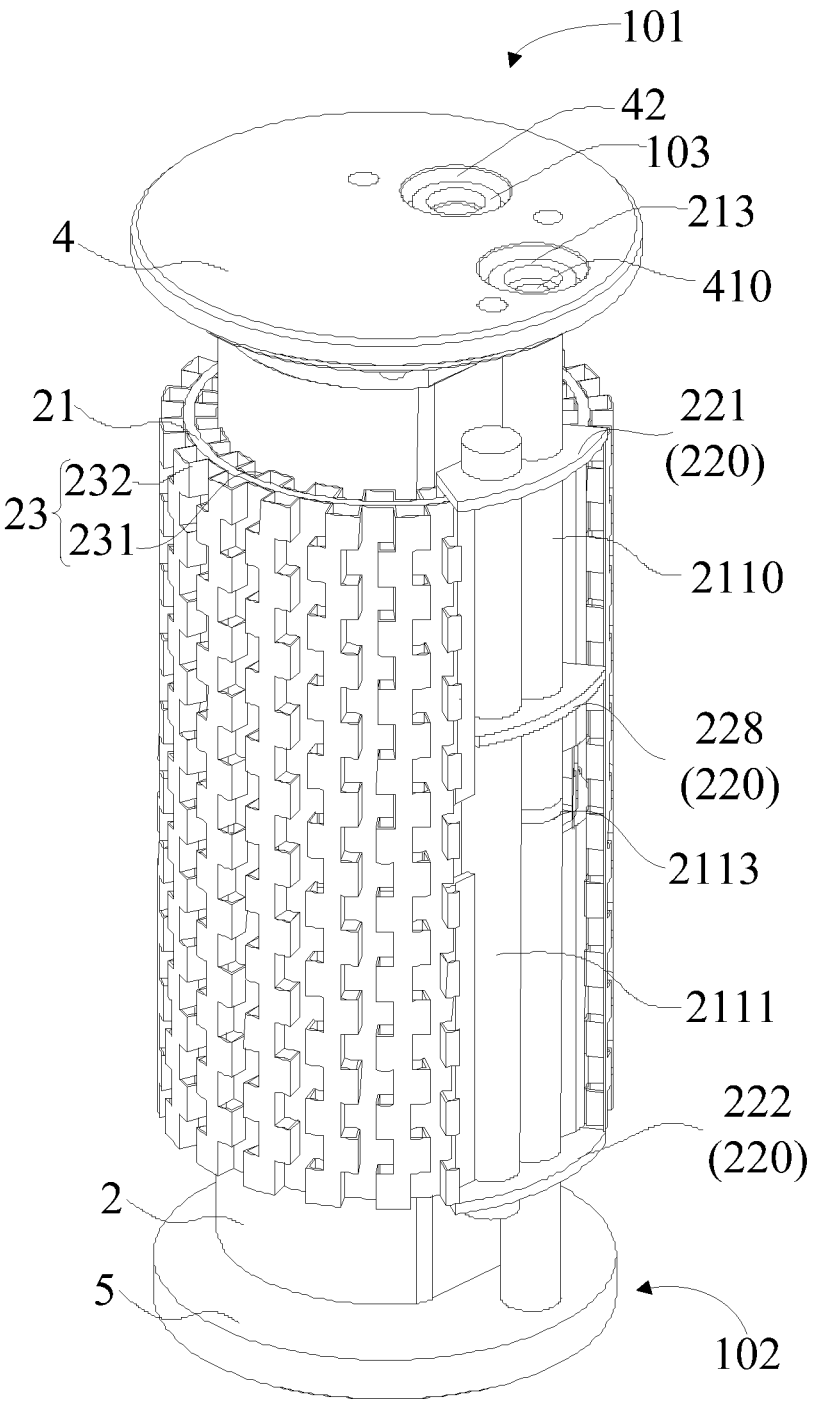
FIG. 33 is a schematic structural view of a gas-liquid separator with the second cylinder removed in accordance with another exemplary embodiment of the present application.

Optionally, as shown in FIG. 33, at least one third baffle 228 may be provided between the first baffle 221 and the second baffle 222 to further increase the baffle effect. The structure of the third baffle 228 and the structure of the first baffle 221 may be substantially the same. This application does not limit the number of baffles and the specific setting methods and positions, which can be set according to the specific application environment.

In other embodiments, the baffle 220 includes an outer baffle 223 (referring to FIGS. 36 to 41). The outer baffle 223 includes a first baffle portion 2231 which extends along a length direction of the collecting pipe 211 and is connected to a side end of the heat dissipation member 23, a second baffle portion 2232 which is clamped to the upper end of the heat dissipation member 23, and a third baffle portion 2233 which is clamped to a lower end of the heat dissipation member 23. At least a part of the outer wall of the first baffle portion 2231 is attached to the inner wall of the second cylinder 3. The first baffle portion 2231 is specifically connected to the side end of the second heat dissipation member 232. The first baffle portion 2231, the second baffle portion 2232 and the third baffle portion 2233 may be integrally formed or formed by splicing. The second baffle portion 2232 and the third baffle portion 2233 have substantially the same structure. Optionally, the second baffle portion 2232 and the third baffle portion 2233 have substantially the same structure as the first baffle 221 described above. Correspondingly, the second baffle portion 2232 and the third baffle portion 2233 have mounting holes 2235 for receiving the collecting pipe 211.

On the outer baffle 223, the first baffle portion 2231 is arranged to help prevent the first refrigerant from flowing from the side end of the second heat dissipation member 232 to the collecting pipe 211. The second baffle portion 2232 and the third baffle portion 2233 are arranged to facilitate blocking the flow of the first refrigerant from the upper and lower ends of the first baffle portion 2231 to the collecting pipe 211.

Optionally, the outer baffle 223 includes at least one fourth baffle portion 2234 located between the second baffle portion 2231 and the third baffle portion 2233. The structure of the fourth baffle portion 2234 and the second baffle portion 2232 are substantially the same.

Figure 37:
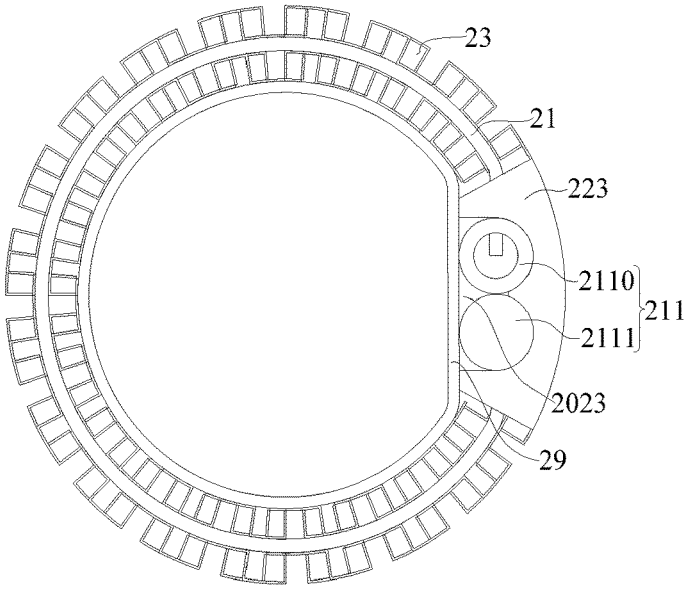
FIG. 37 is a top view of a partial structure of the gas-liquid separator shown in FIG. 36.
Figure 38:
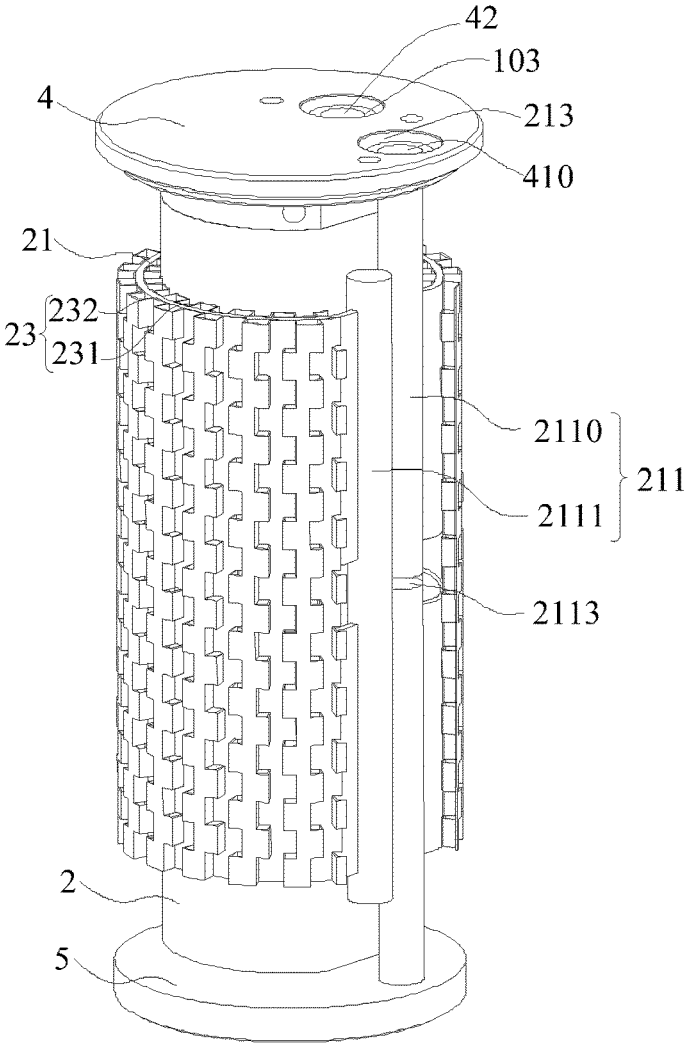
FIG. 38 is a structural schematic view of the gas-liquid separator shown in FIG. 36 with the second cylinder and the baffle removed.
Figure 39:
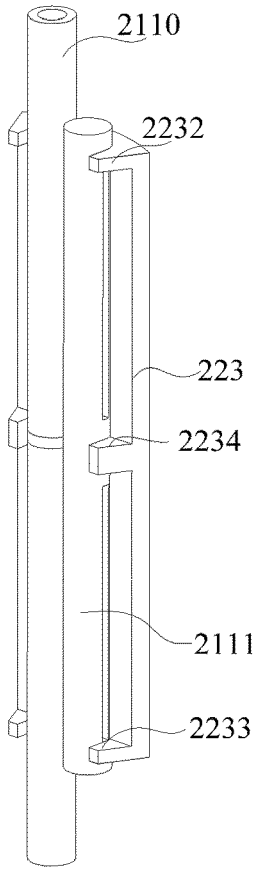
FIG. 39 is a combined structure view of a baffle and a collecting pipe in an exemplary embodiment of the present application.
Figure 40:
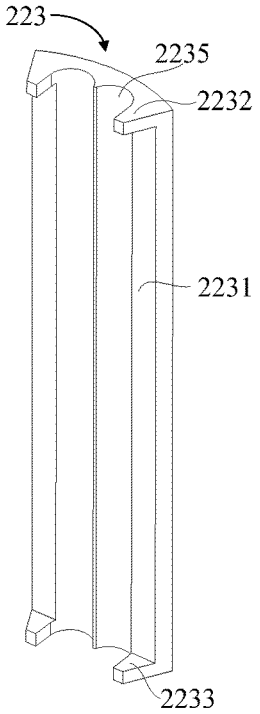
FIG. 40 is a schematic structural view of the baffle of another exemplary embodiment of the present application.
Figure 41:
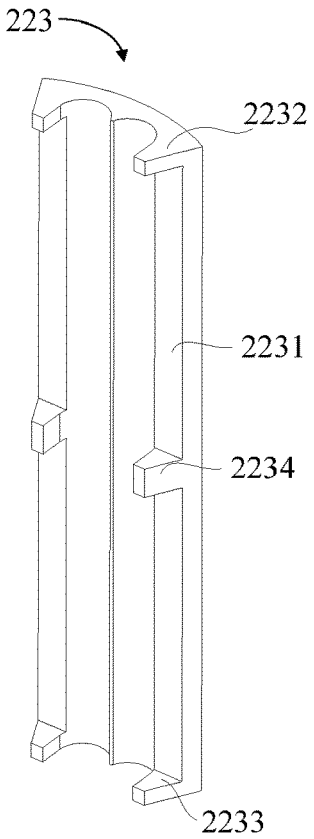
FIG. 41 is a schematic structural view of the baffle of another exemplary embodiment of the present application.
Figure 42:
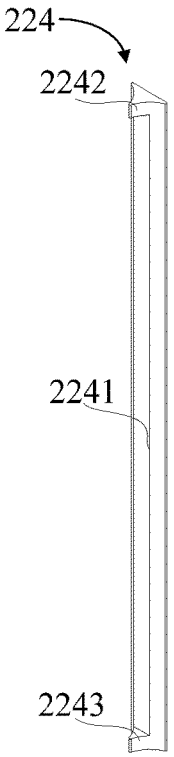
FIG. 42 is a schematic structural view of the baffle of another exemplary embodiment of the present application.
Figure 43:
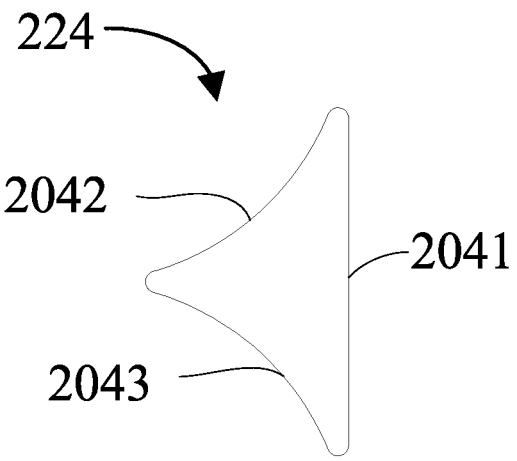
FIG. 43 is a top view of the baffle shown in FIG. 42.
Figure 44:
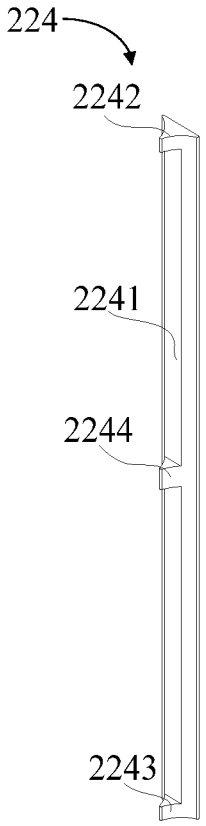
FIG. 44 is a schematic structural view of the baffle in accordance with another exemplary embodiment of the present application.

Optionally, as shown in FIGS. 42 to 44, the baffle 220 includes an inner baffle 224. At least a part of the side wall of the inner baffle 224 is attached to the outer wall of the first cylinder 2. The inner baffle 224 can be arranged in a receiving space 2023 as shown in FIG. 37, and the inner baffle 224 and the outer baffle 223 are arranged oppositely. The receiving space 2023 is enclosed by the avoidance portion 29 and the outer side wall of the collecting pipe 211. The inner baffle 224 includes a fifth baffle portion 2241 extending along the length direction of the collecting pipe 211 and connected to the side end of the first heat dissipation member 231, and a sixth baffle portion 2242 and a seventh baffle portion 2243 provided at both ends of the fifth baffle portion 2241. The sixth baffle portion 2242 and the seventh baffle portion 2243 both extend toward a side where the collecting pipe is located, and can be attached to the outer wall of the collecting pipe 211.

Correspondingly, the sixth baffle portion 2242 includes side surfaces 2042, 2043 attached to the collecting pipe 211 and a side surface 2041 facing the side of the first cylinder 2. The side surfaces 2042, 2043 are generally curved. The shape of the side surface 2041 can be set according to the shape of the first cylinder 2. For example, the side surface 2041 may be substantially flat in order to fit with the avoidance portion 29. Of course, if the first cylinder 2 is in the shape of a hollow cylinder, that is, when the first cylinder 2 is not provided with the avoidance portion 29, the side surface 2041 can be a concave curved surface similar to the side surface 2042 in order to adhere to the outer wall of the first cylinder 2. Correspondingly, for the side wall of the fifth baffle portion 2241 facing the first cylinder 2, the wall surface of the side wall and the side surface 2041 may be substantially in the same plane, or may be set according to the specific shape and structure of the outer wall of the first cylinder 2.

Optionally, the inner baffle 224 includes at least one eighth baffle portion 2244 located between the sixth baffle portion 2242 and the seventh baffle portion 2243. The structure of the eighth baffle portion 2244 and the sixth baffle portion 2242 are substantially the same.

Figure 45:
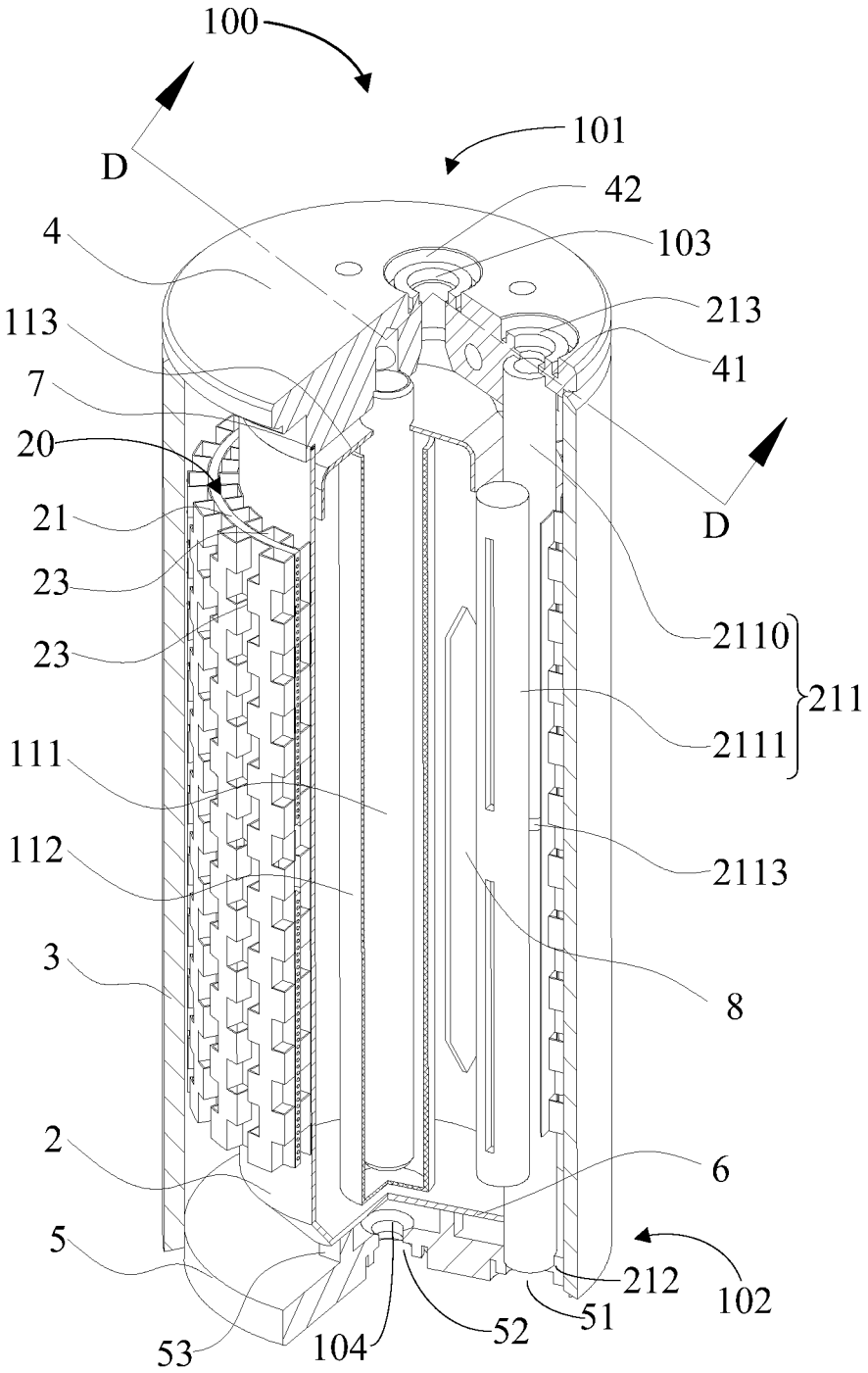
FIG. 45 is a schematic view of a perspective structure of another gas-liquid separator in accordance with an exemplary embodiment of the present application.
Figure 46:
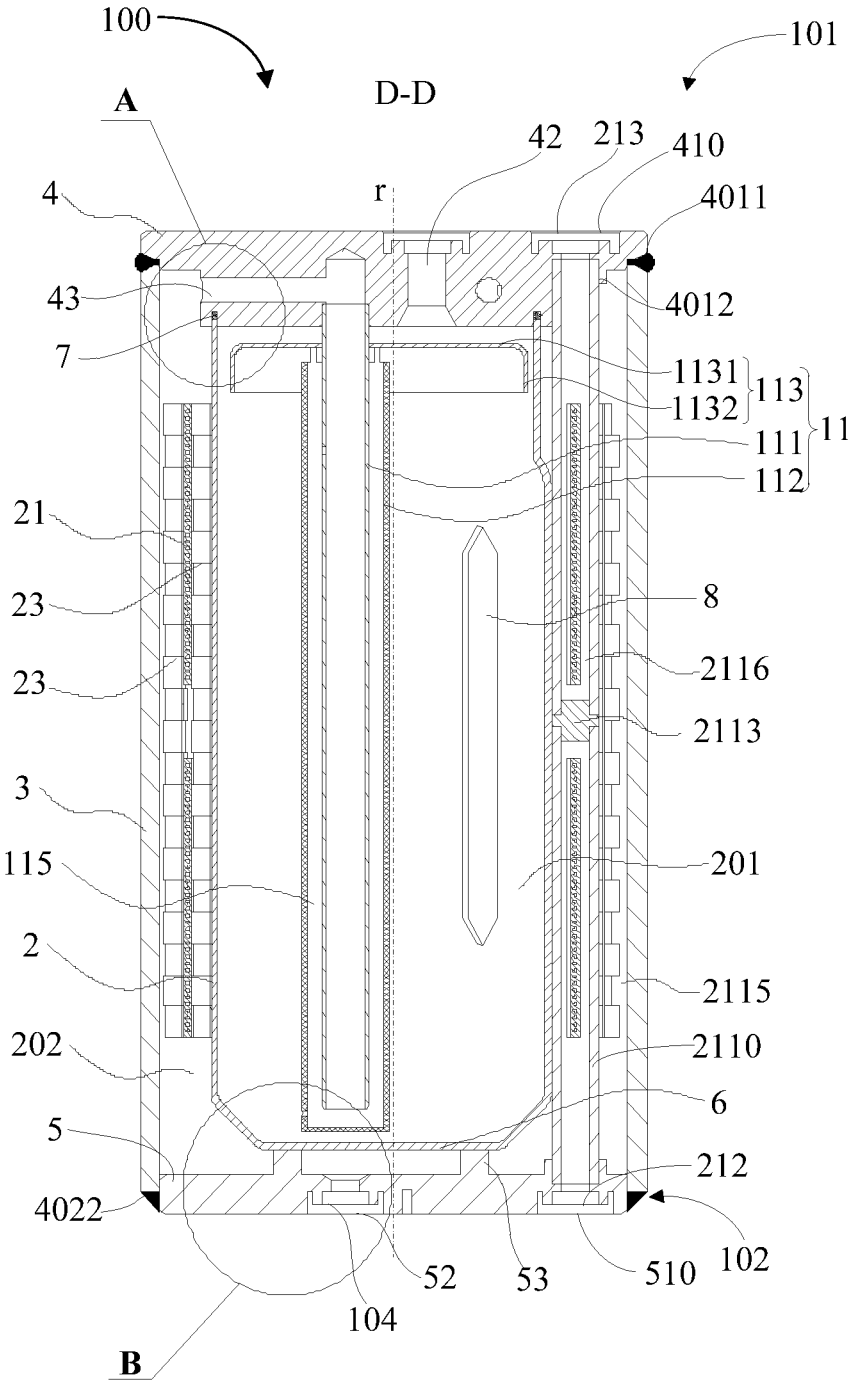
FIG. 46 is a schematic cross-sectional view of the gas-liquid separator taken along a section line D-D shown in FIG. 45.

In some embodiments, as shown in FIGS. 45 and 46, the first end cover 4 has a first welding port 4011 for welding with the second cylinder 3. The first welding port 4011 is located at an outer edge of the first end cover 4, and the first welding port 4011 can be ring-shaped to fit with the upper end of the second cylinder 3. The connection between the bottom of the second cylinder 3 and the second end cover 5 further includes a third welding port 4022. The third welding port 4022 may be chamfered, as shown in FIG. 46. The chamfered third welding port 4022 is formed by the bottom end surface of the second cylinder 3 and the outer peripheral side surface of the second end cover 5. A sealing element 7 is sandwiched between the first cylinder 2 and the first end cover 4. The sealing element 7 is in contact with the first cylinder 2 and the first end cover 4 so as to seal the first cylinder 2. The upper end of the second cylinder 3 is welded to the first end cover 4. Since the chamber 201 is in communication with the interlayer space 202, for example, through a channel 43 described below, the pressure on the inner and outer sides of the first cylinder 2 is equal. The sealing element 7 contacts the first cylinder 2 and the first end cover 4 in order to seal the first cylinder, which can well meet the structural requirements. In addition, the structure of the sealing element 7 is simple, and it is easy to produce and install. Especially compared to connecting the first cylinder 2 and the first end cover 4 by welding, the installation of the sealing element 7 will not be adversely affected due to the limited size of the gas-liquid separator 100. That is, when there are many components of the gas-liquid separator, compared to the installation of the components of the gas-liquid separator by welding, the sealing element in the embodiment of the present application makes the installation between the first cylinder 2 and the first end cover 4 simple and easy to operate. The first cylinder 2 and the first end cover 4 do not need to be welded, which reduces the total number of welding, thereby it is beneficial to save installation time and improve the overall installation efficiency of the gas-liquid separator 100. In addition, since the chamber inside the first cylinder and the interlayer space outside the first cylinder are communicated, the air pressure on both sides of the inside and outside of the first cylinder is consistent. Sealing by the sealing element contacting the first end cover and the first cylinder can well meet the overall requirements of the structure. Moreover, because the air pressure on both sides of the inner and outer sides of the first cylinder is consistent, only a small pressing force is required to meet the installation requirements during installation.

In some embodiments, the sealing element 7 is a sealing ring, such as a rubber sealing ring. This application does not limit this, and it can be set according to specific applications.

Taking the sealing element 7 as a sealing ring as an example, the cross-sectional shape of the sealing ring can be one or a combination of a circle, a rectangle, an ellipse, and the like.

Figure 34:
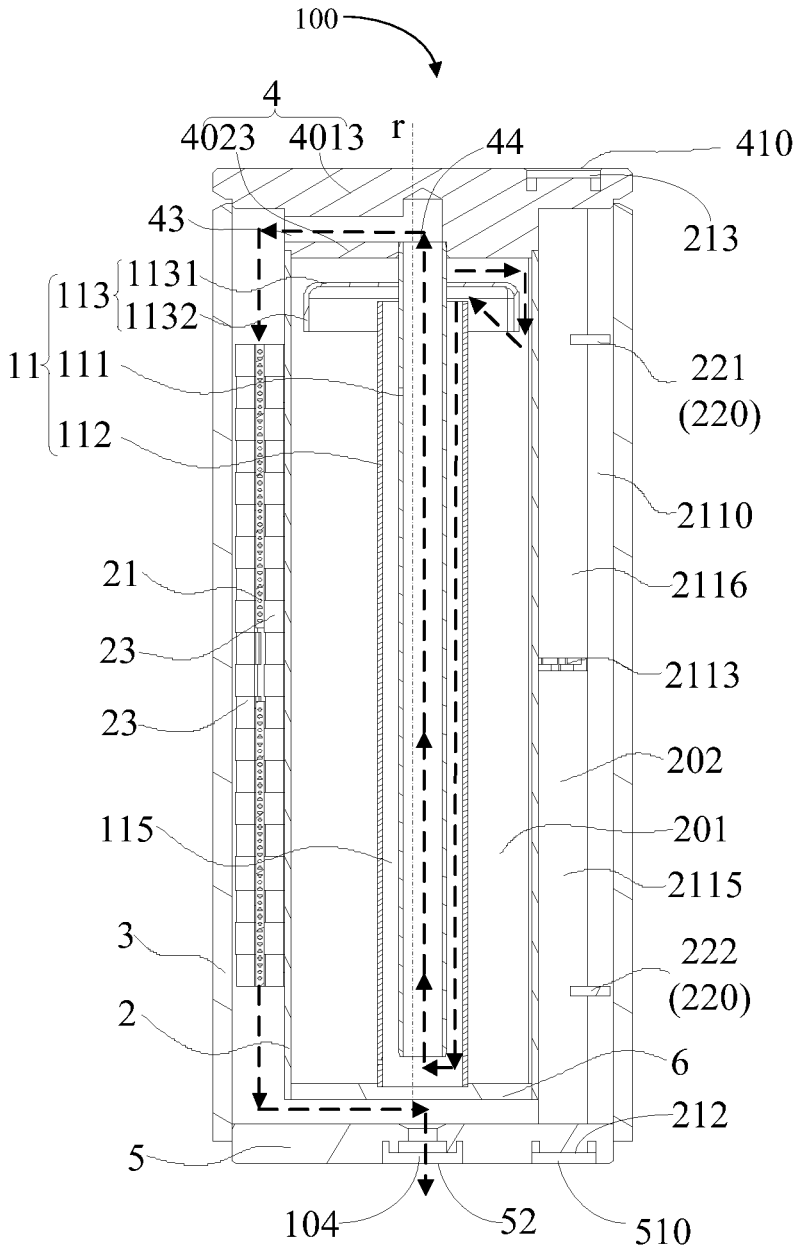
FIG. 34 is a schematic cross-sectional view from a perspective of the gas-liquid separator of an exemplary embodiment of the present application, in which the flow direction of the first refrigerant is shown.
Figure 35:
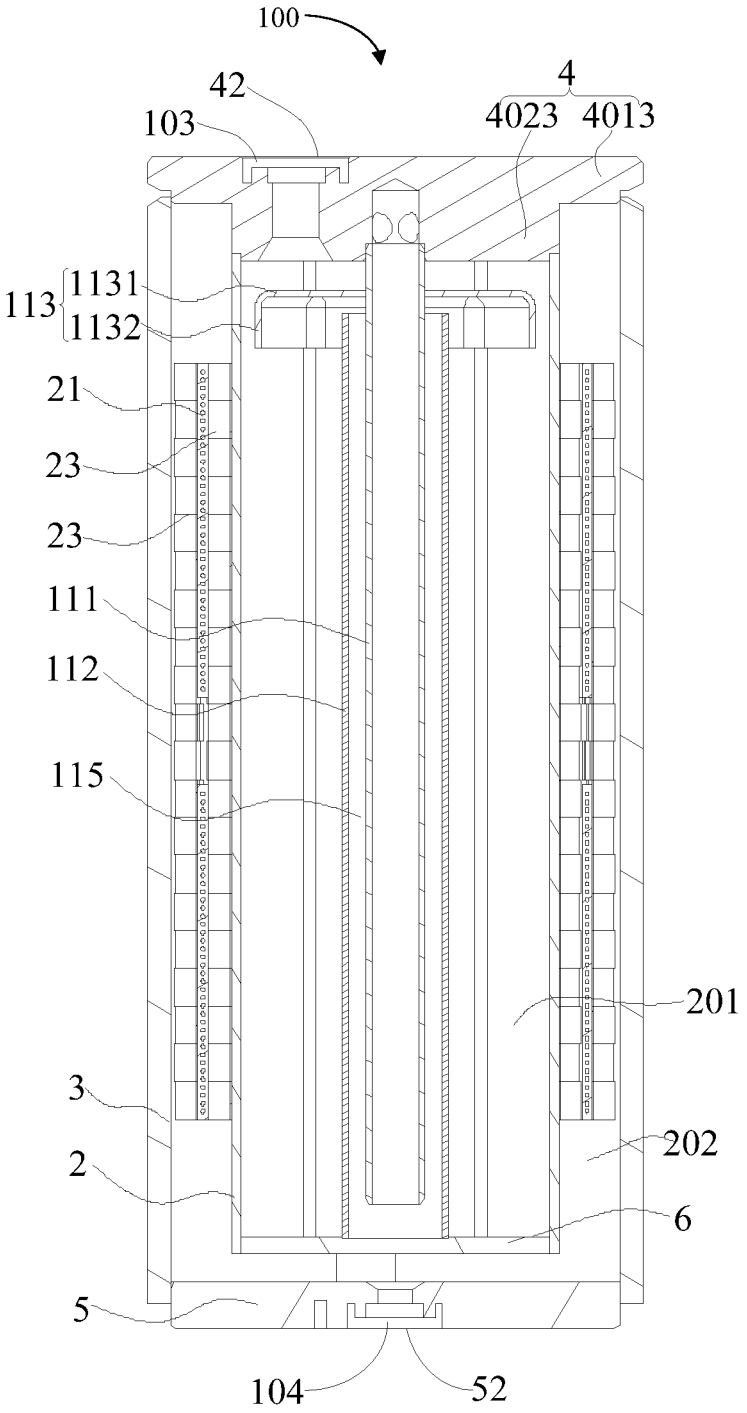
FIG. 35 is a schematic cross-sectional view of the gas-liquid separator of an exemplary embodiment of the present application from another perspective.
Figure 36:
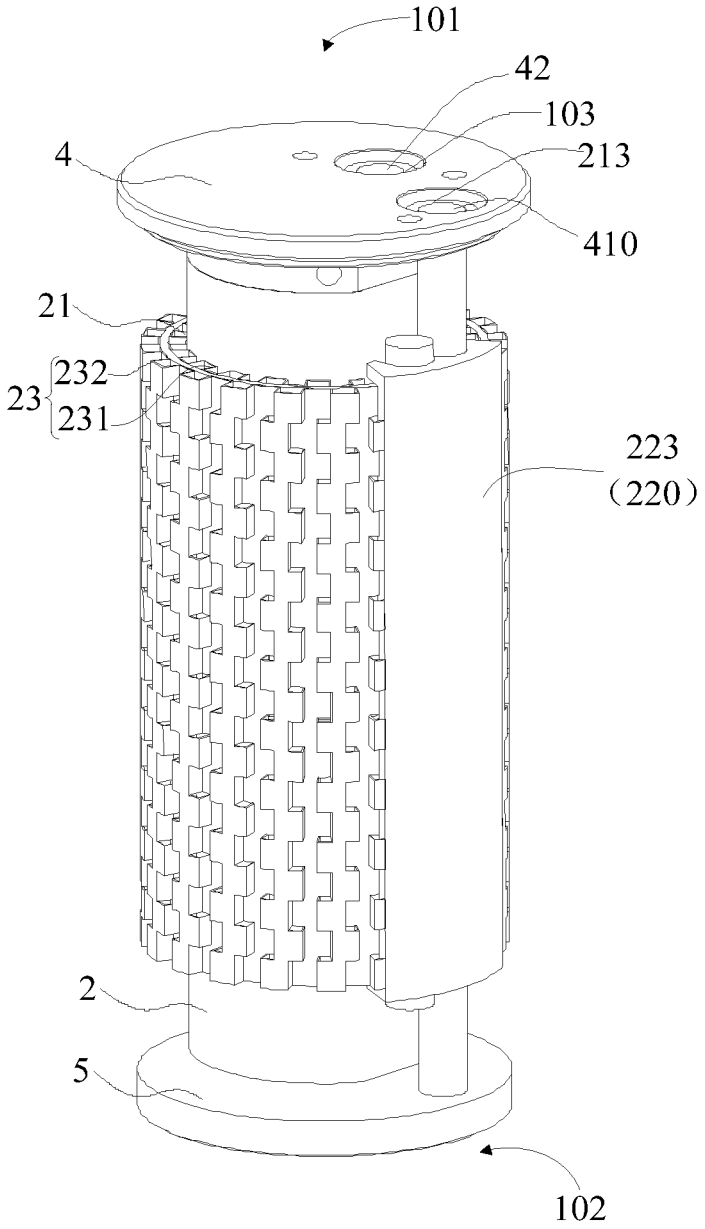
FIG. 36 is a schematic structural view of the gas-liquid separator with the second cylinder removed in accordance with another exemplary embodiment of the present application.
Figure 49:
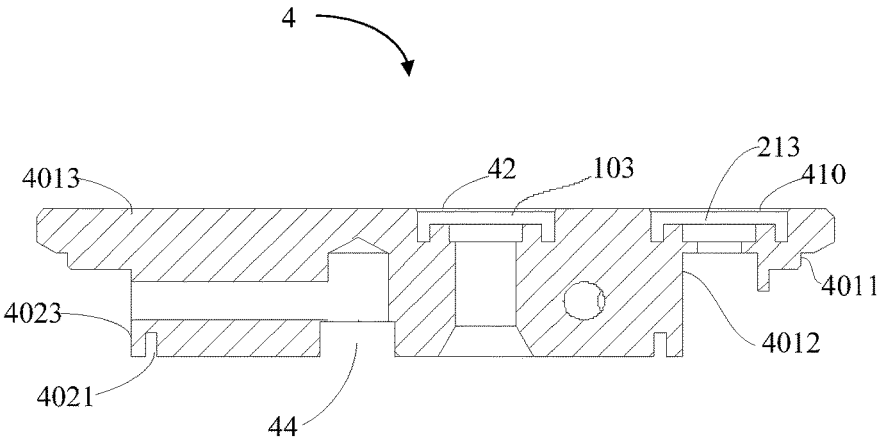
FIG. 49 is a schematic structural view of a first end cover of an exemplary embodiment of the present application.
Figure 50:
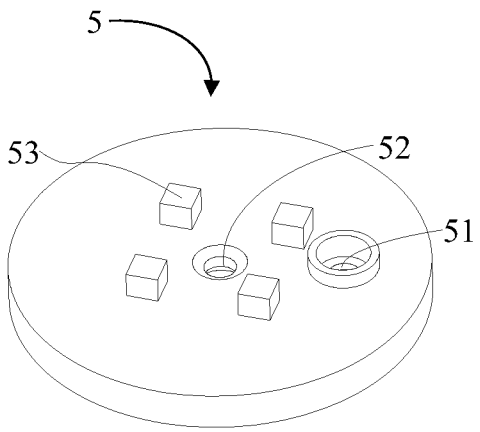
FIG. 50 is a schematic structural view of a second end cover in accordance with an exemplary embodiment of the present application.

For example, as shown in FIGS. 34, 35 and 49, in the case where the first end cover 4 does not include a pressing cover, the first end cover 4 includes a first covering portion 4013 which covers the second cylinder 3, and a second covering portion 4023 which extends downwardly from the first covering portion 4013 and covers the first cylinder 2. As shown in FIG. 49, the first covering portion 4013 has a second welding port 4012 located below the first through hole 410 and communicating with the first through hole 410. The first collecting pipe 2110 and the first end cover 4 are connected by welding at the second welding port 4012. The second welding port 4012 can be regarded as two holes independent of the first through hole 410. Of course, in other embodiments, the second welding port can also be regarded as part of the first through hole. In addition, the aforementioned first welding port 4011 is specifically located at an outer edge of the first covering portion 4013.

Figure 47:
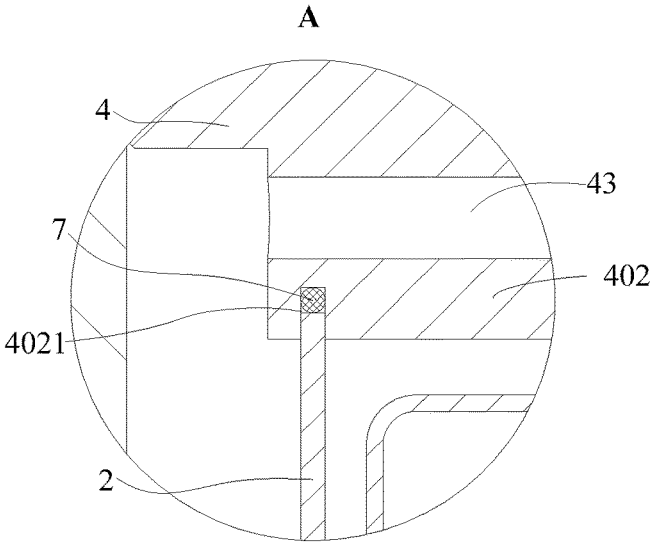
FIG. 47 is an enlarged schematic view of part A of the gas-liquid separator shown in FIG. 46.
Figure 48:
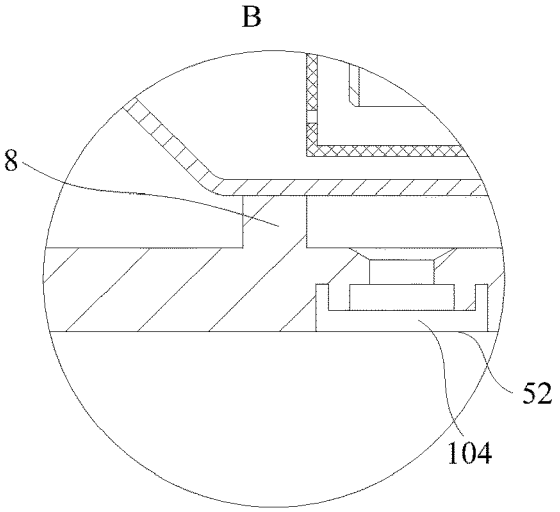
FIG. 48 is an enlarged schematic view of part B of the gas-liquid separator shown in FIG. 46.

Optionally, in some embodiments, as shown in FIG. 47, the second covering portion 402 is provided with an installation groove 4021, and the sealing element 7 is disposed in the installation groove 4021. In other embodiments, the sealing element 7 can also be directly arranged on the upper end of the first cylinder 2, and the first cylinder 2 is directly abutted to the lower end of the second end cover 5 through the sealing element 7. Of course, the sealing element 7 can also be provided in other ways, which is not limited in this application, and it may be set in a specific application environment.

In some embodiments, as shown in FIGS. 1, 45, 46, and 50 to 53, a side of the second end cover 5 facing the first cylinder 2 is provided with a boss 53 which is capable of abutting against the bottom of the first cylinder. The boss 53 can be integrally formed with the second end cover 5, or can be arranged on the second end cover 5 by a connection method such as welding. The boss 53 serves as a pressure block so that the pressing force acting on the second end cover 5 can be transmitted to the first cylinder 2 through the boss 53 during installation. The arrangement of the boss 53 facilitates the installation of the first cylinder 2.

Figure 51:
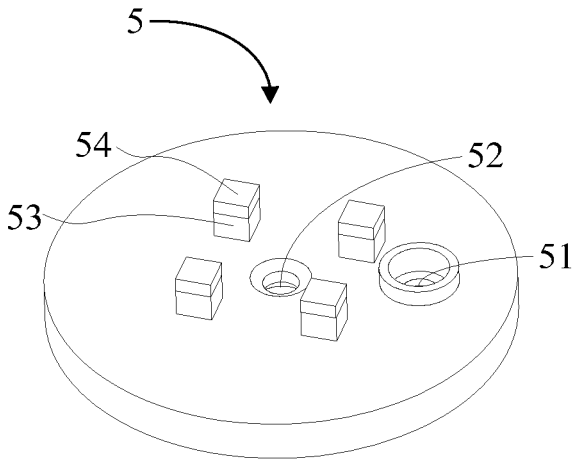
FIG. 51 is a schematic structural view of another second end cover in accordance with an exemplary embodiment of the present application.

In other embodiments, as shown in FIG. 51, in addition to the boss 53 provided between the second end cover 5 and the first cylinder 2, a spacer 54 is also provided. The spacer is arranged on the boss 53 and can abut against the lower end of the first cylinder 2. The material of the spacer 54 may be an elastic material such as rubber. This makes it possible to greatly improve the anti-vibration performance of the gas-liquid separator when the liquid refrigerant is stored in the first cylinder 2, especially when there is more liquid refrigerant in the first cylinder 2, which is beneficial to improve the stability of the gas-liquid separator. At the same time, the combination of the spacer 54 and the boss 53 can also transmit the pressing force to the first cylinder 2.

In other embodiments, the side of the second end cover 5 facing the first cylinder 2 is provided with a spacer which is capable of abutting against the cylinder bottom of the first cylinder 2. For example, the side of the second end cover 5 facing the first cylinder 2 is not provided with a boss, which can transmit the pressing force to the first cylinder and can improve the anti-vibration performance of the gas-liquid separator. This application does not limit the setting of the boss and the spacer, and it can be set according to the specific application environment.

Further, referring back to FIGS. 1 to 3, the gas-liquid separation assembly 11 includes a gas guide tube 111, a sleeve 112 sleeved around the outside of the gas guide tube 111, and a cap 113 sleeved on an upper part of the gas guide tube 111 and located above the sleeve 112.

For example, as shown in FIGS. 14, 34 and 35, the cap 113 includes a main body portion 1131 sleeved on the gas guide tube 111 and an extension portion 1132 extending downwardly along an outer edge of the main body portion 1131. A gap is formed between an upper surface of the main body portion 1131 and a lower surface of the first end cover 4 so that the first refrigerant can flow from the first connecting pipe 103 into the chamber 201. A gap is formed between an outer wall surface of the extension portion 1132 and an inner wall surface of the first cylinder 2 so that the first refrigerant continues to flow downwardly after entering the chamber 201 from the first connecting pipe 103. A gap is formed between a lower surface of the main body portion 1131 and an upper end surface of the sleeve 112, a gap is formed between an inner wall surface of the extension portion 1132 and an outer wall of the sleeve 112, and an upper end of the sleeve 112 is open so that the chamber 201 is in communication with a passage 115 described below.

An inner wall surface of the sleeve 112 and an outer wall surface of the gas guide tube 111 are separated by a predetermined distance, so that the passage 115 for the first refrigerant to flow is formed between the inner wall surface of the sleeve 112 and the outer wall surface of the gas guide tube 111. A lower end of the sleeve 112 is disposed on the inner end cover 6 (here the inner end cover 6 can be replaced by the blocking portion 28), and is connected to the inner end cover 6. For example, the lower end of the sleeve 112 abuts against the inner end cover 6 so as to be sealed, thereby isolating a lower end of the passage 115 from the chamber 201. A gap is left between a lower end surface of the gas guide tube 111 and the inner end cover 6 so that the passage 115 communicates with inside of the gas guide tube 111.

As shown in FIGS. 3, 14 to 16, 20, 22, 24, 34 and 46, the first end cover 4 is provided with a channel 43 extending in a radial direction of the first end cover 4, and an upper end of the gas guide tube 111 is inserted inside the first end cover 4. One end of the channel 43 communicates with an inner space of the gas guide tube 111, and the other end communicates with the interlayer space 202. Among them, the number of channels 43 may include at least one. A collecting hole 44 is provided at a lower end of the first end cover 4, and at least one channel 43 converges in the collecting hole 44. Correspondingly, the upper end of the gas guide tube 111 is inserted into the collecting hole 44 so that the channel 43 communicates with the inner space of the gas guide tube 111.

Furthermore, as shown in FIGS. 1, 45 and 46, a molecular sieve 8 may also be provided in the first cylinder 2. The molecular sieve 8 is disposed in the chamber 201, for example, the molecular sieve 8 can be connected to the gas-liquid separation assembly 11.

Figure 11:
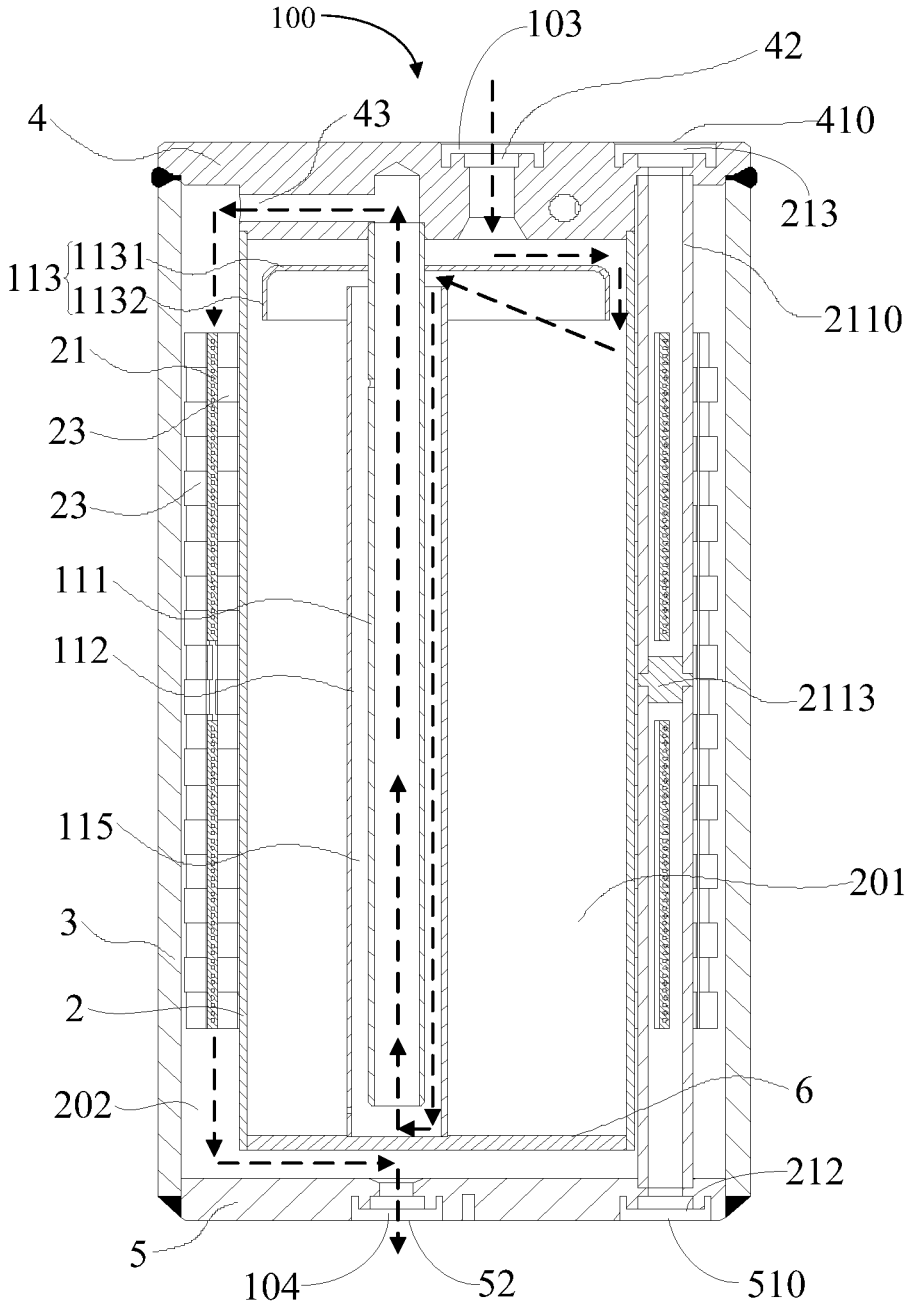
FIG. 11 is a schematic view of the flow of a first refrigerant in the gas-liquid separator of an exemplary embodiment of the present application.

In some embodiments, as shown in FIG. 11, when the gas-liquid separator includes the avoidance portion, and when the gas-liquid separator 100 is specifically working, the flow direction of the first refrigerant is the direction indicated by arrows in FIG. 11. The first refrigerant flows from the first connecting pipe 103 into the chamber 201, and continues to flow downwardly through the gap between the extension portion 1132 and the inner wall surface of the first cylinder 2. After that, the first refrigerant sequentially flows through the gap between the inner wall surface of the extension portion 1132 and the outer wall surface of the sleeve 112, the gap between the lower surface of the main body portion 1131 and the upper end surface of the sleeve 112, and then enters the passage 115 from the upper end of the sleeve 112 and continues to flow downwardly in the passage 115. After that, the first refrigerant enters the gas guide tube 111 from the lower end of the gas guide tube 111 and continues to flow upwardly in the gas guide tube 111. After that, the first refrigerant enters the interlayer space 202 through the channel 43 and continues to flow downwardly. Finally, the first refrigerant flows out of the gas-liquid separator 100 through the second connecting pipe 104 to enter the compressor. As a result, the first refrigerant completes the entire process of gas-liquid separation and heat exchange. When the first refrigerant flows in the interlayer space 202, it exchanges heat with the second refrigerant in the flat tube 21 through the tube wall of the flat tube 21 and the heat dissipation member 23.

It should be noted that the first refrigerant that enters the chamber 201 from the first connecting pipe 103 is usually a gas-liquid mixed first refrigerant. After entering the chamber 201, the liquid first refrigerant sinks due to gravity, while the gaseous first refrigerant floats up and enters the passage 115 from the upper end of the sleeve 112 so as to achieve gas-liquid separation of the first refrigerant.

Figure 12:
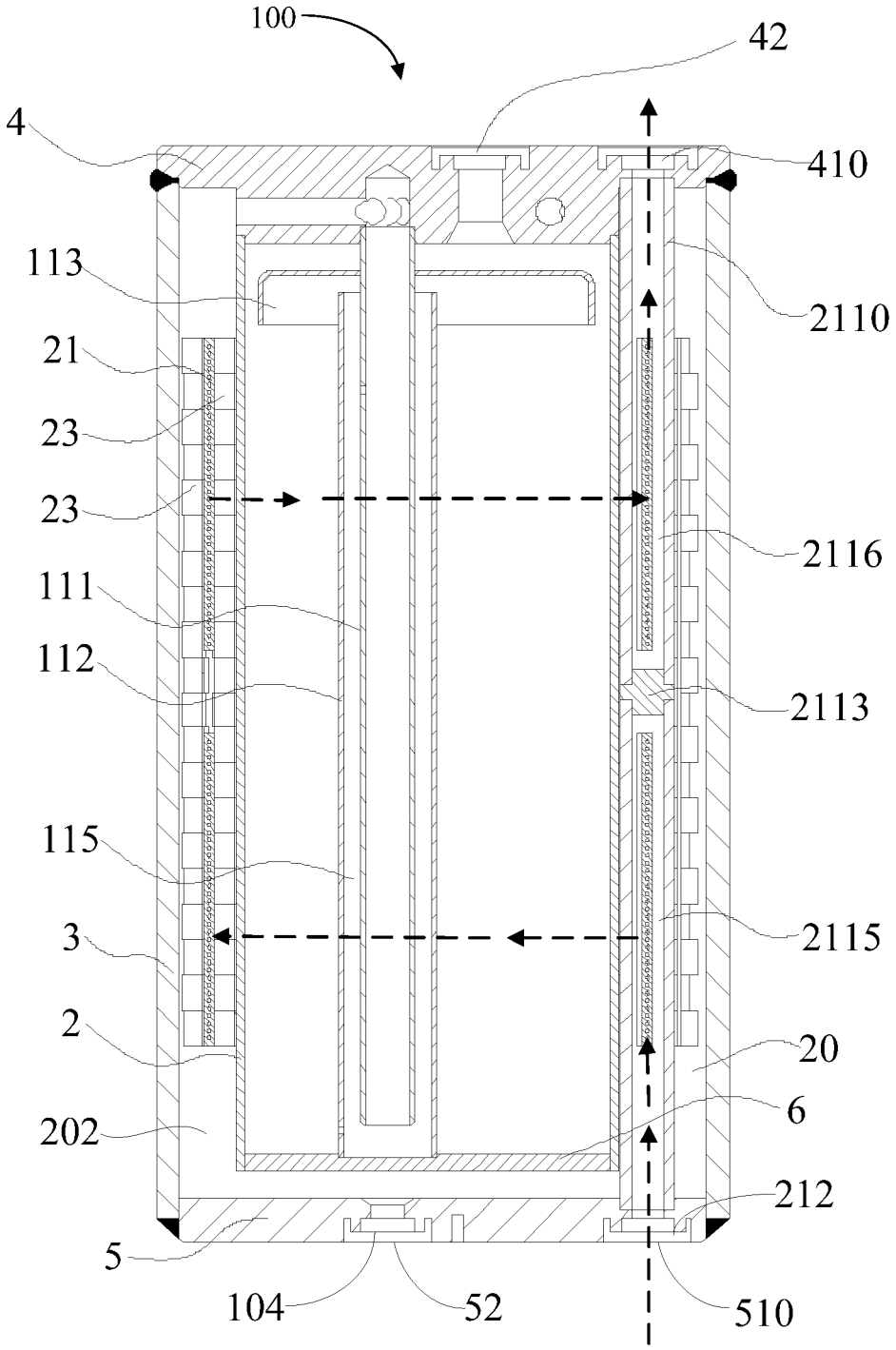
FIG. 12 is a schematic view of the flow of a second refrigerant in the gas-liquid separator of an exemplary embodiment of the present application.
Figure 13:
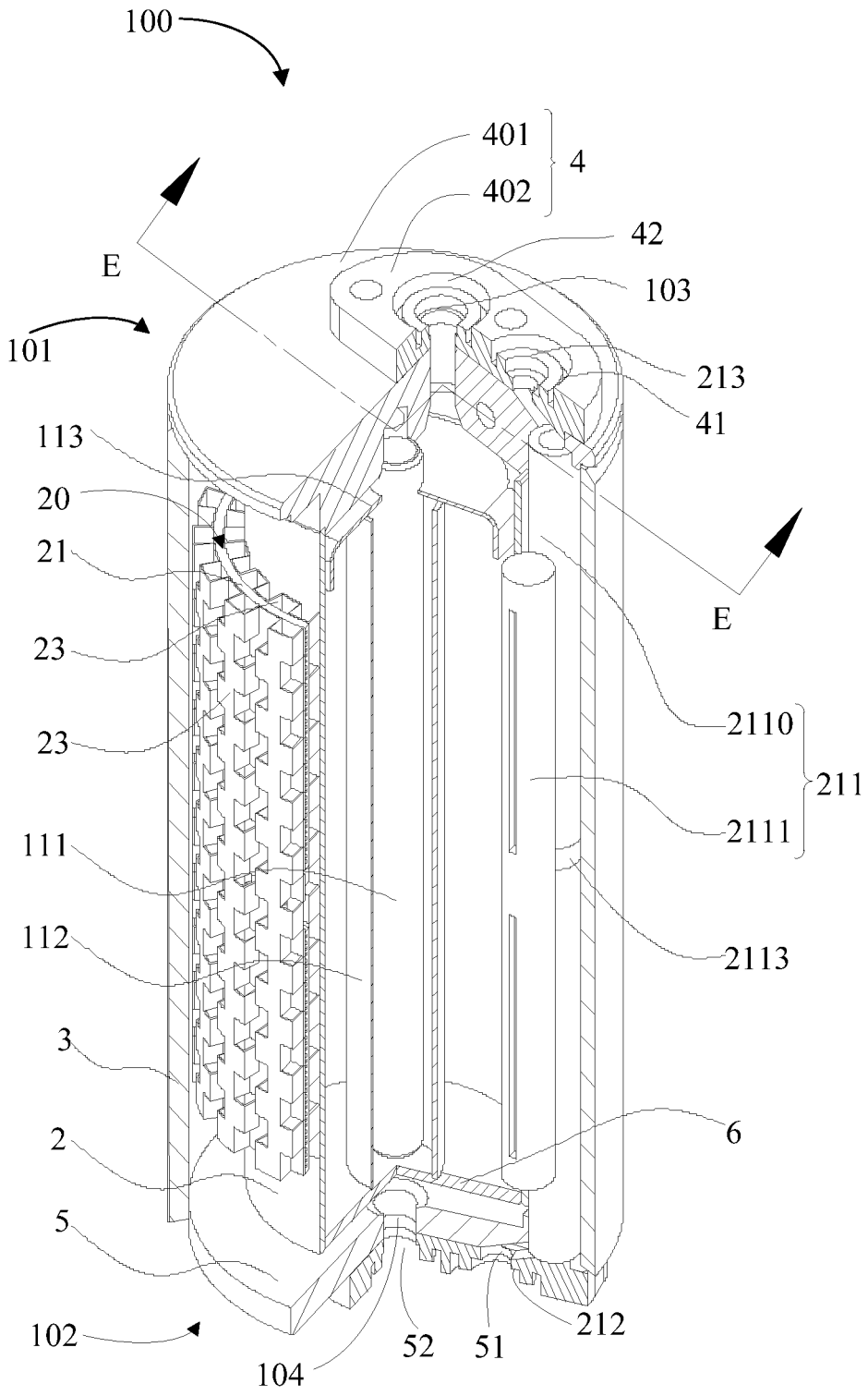
FIG. 13 is a schematic view of a perspective structure of another gas-liquid separator in accordance with an exemplary embodiment of the present application.

In the case where the gas-liquid separator includes the avoidance portion, the flow direction of the second refrigerant is the direction indicated by arrows in FIG. 12. The second refrigerant enters the first chamber 2115 from the second joint 212 which is provided in the second through hole 510. Then, the second refrigerant flows into the second collecting pipe 2111 through the flat tube 21 which is in communication with the first chamber 2115. Then, the second refrigerant flows upwardly in the second collecting pipe 2111. After that, the second refrigerant flows into the second chamber 2116 through a part of the flat tube 21. Finally, the second refrigerant flows out through the first joint 213 provided in the first through hole 410. As a result, the second refrigerant completes the heat exchange process.

Figure 26:
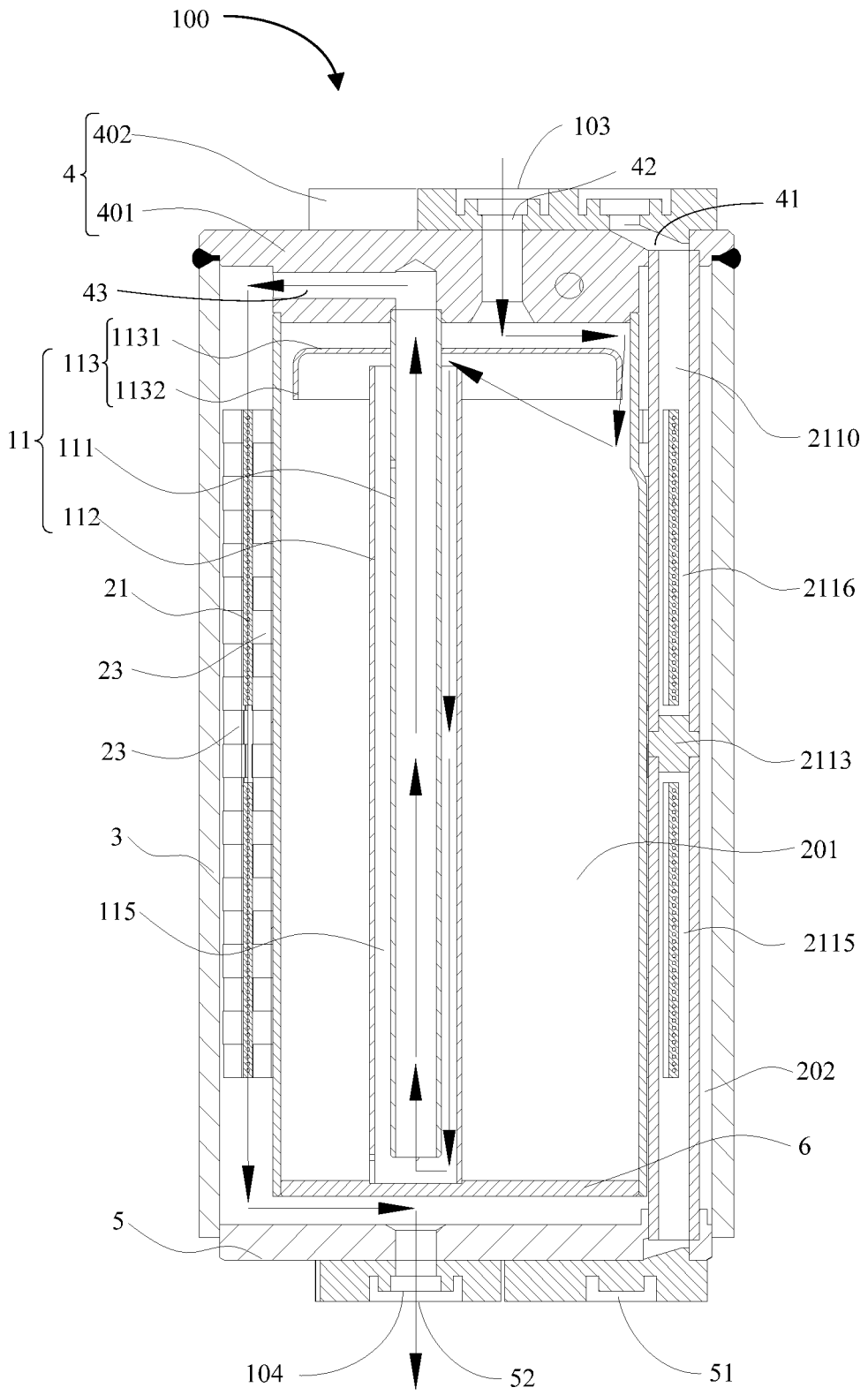
FIG. 26 is a schematic view of the flow of the first refrigerant of another gas-liquid separator in accordance with an exemplary embodiment of the present application.

In some embodiments, as shown in FIG. 26, when the gas-liquid separator 100 includes the avoidance portion 29, and the first end cover 4 includes the pressing cover 402 and the body portion 401, when the gas-liquid separator 100 is specifically working, the flow direction of the first refrigerant is the direction indicated by arrows in FIG. 26. The working principle of the gas-liquid separator 100 when the first refrigerant is circulating is the same as that described above, which will not be repeated here.

Figure 27:
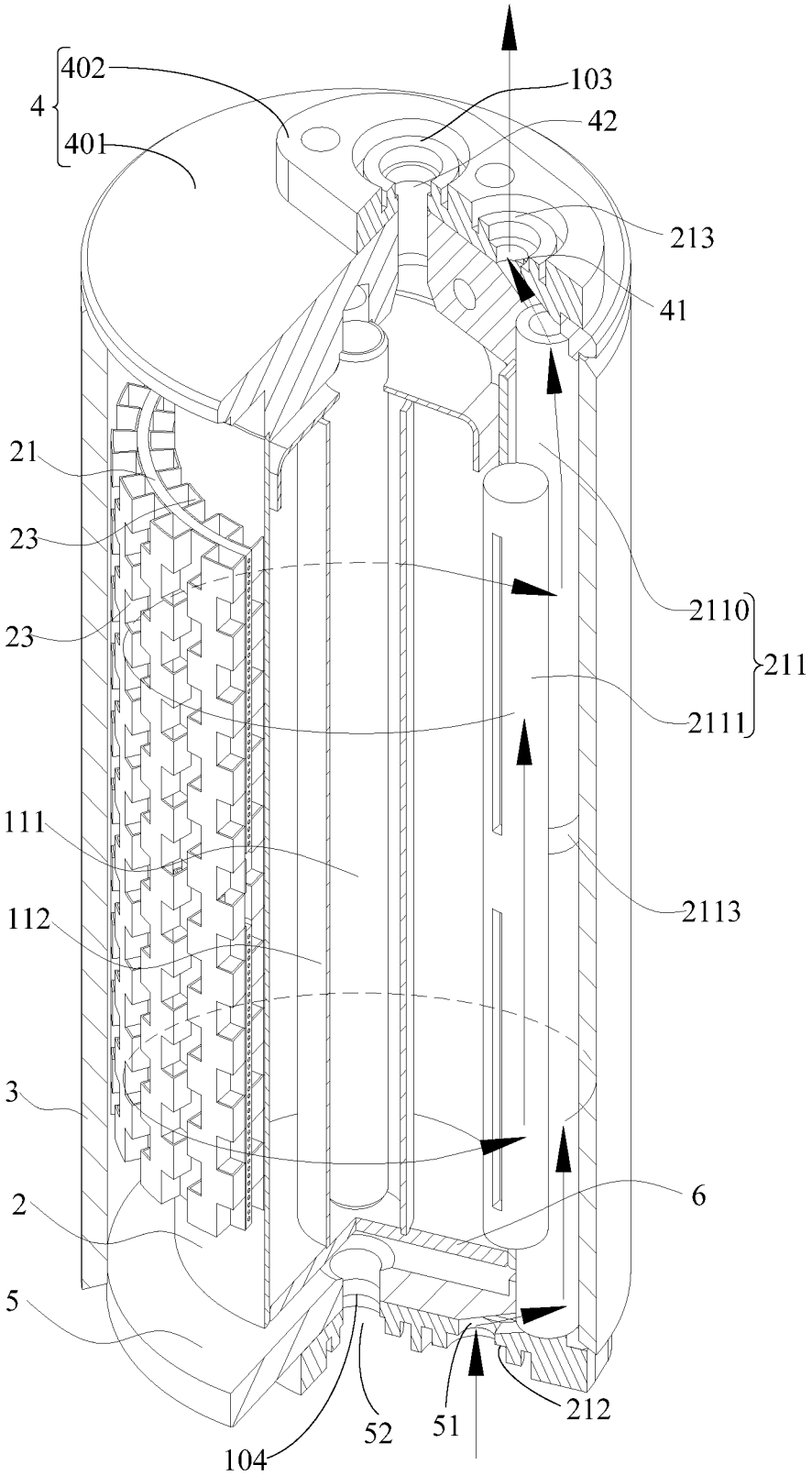
FIG. 27 is a schematic view of the flow of the second refrigerant of another gas-liquid separator in accordance with an exemplary embodiment of the present application.

In the case where the gas-liquid separator includes the avoidance portion 29, and the second end cover 5 includes the pressing cover and the body portion, the flow of the second refrigerant is in the direction indicated by arrows in FIG. 27. The second refrigerant enters the first chamber 2115 from the second joint 212 provided in the bend passage 51, then flows into the second collecting pipe 2111 through the flat tube 21 communicating with the first chamber 2115, and then flows upwardly in the second collecting pipe 2111. After that, the second refrigerant flows into the second chamber 2116 through a part of the flat tube 21. Finally, the second refrigerant flows out through the first joint 213 provided in the bend channel 41. As a result, the second refrigerant completes the heat exchange process.

In some embodiments, as shown in FIG. 34, when the gas-liquid separator 100 includes the avoidance portion 29 and the baffle 220, and when the gas-liquid separator 100 is specifically working, the flow direction of the first refrigerant is the direction indicated by arrows in FIG. 34. In addition, the working principle of the gas-liquid separator 100 when the first refrigerant and the second refrigerant are circulating is the same as that described above, which will not be repeated here.

Figure 52:
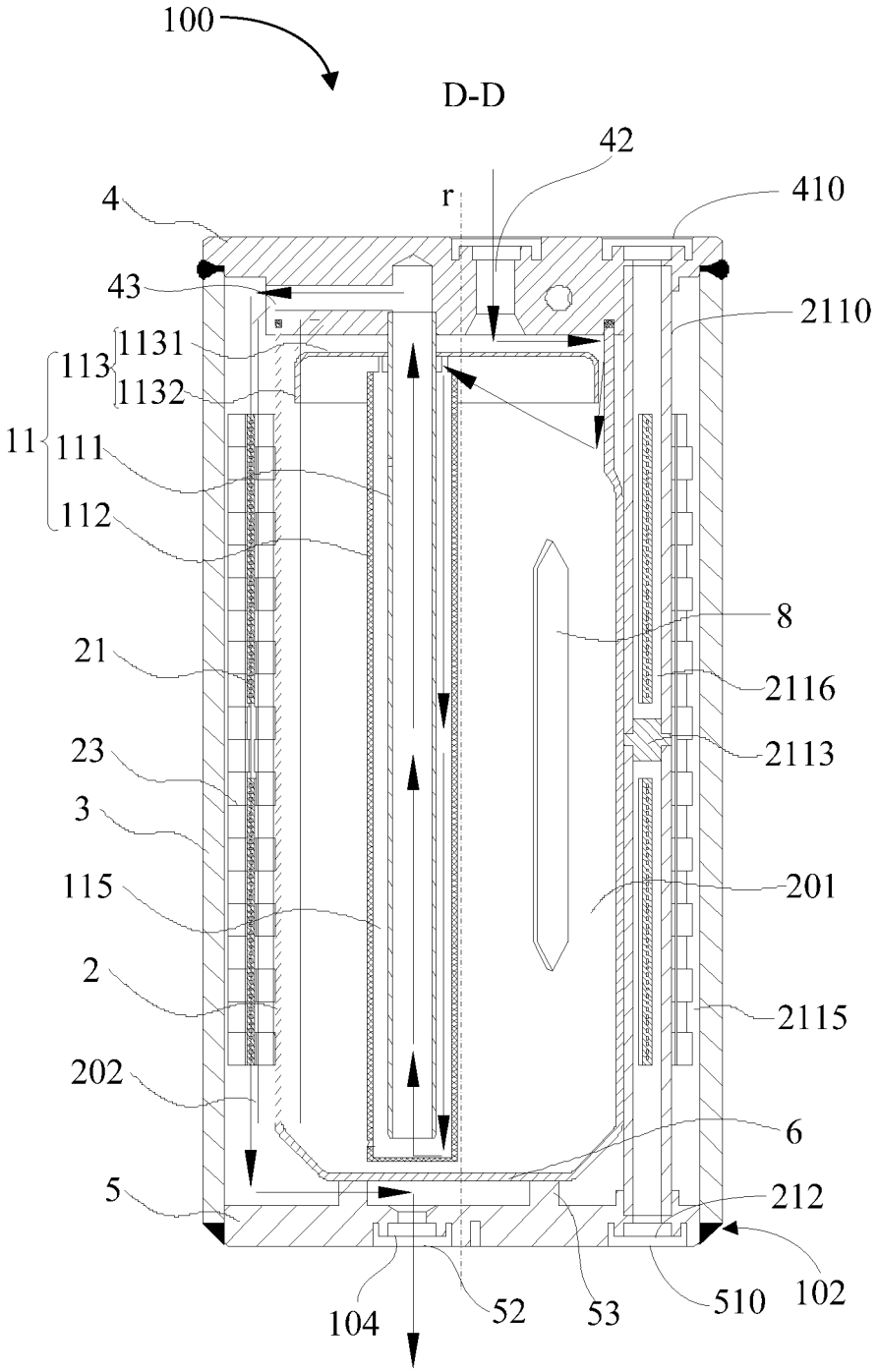
FIG. 52 is a schematic view of the flow of the first refrigerant of another gas-liquid separator in accordance with an exemplary embodiment of the present application.

In some embodiments, as shown in FIG. 52, when the gas-liquid separator 100 includes the avoidance portion 29, the sealing element 7 and the boss 53, and when the gas-liquid separator 100 is specifically working, the flow direction of the first refrigerant is the direction indicated by arrows in FIG. 52. The working principle of the gas-liquid separator 100 when the first refrigerant is circulating is the same as that described above, which will not be repeated here.

Figure 53:
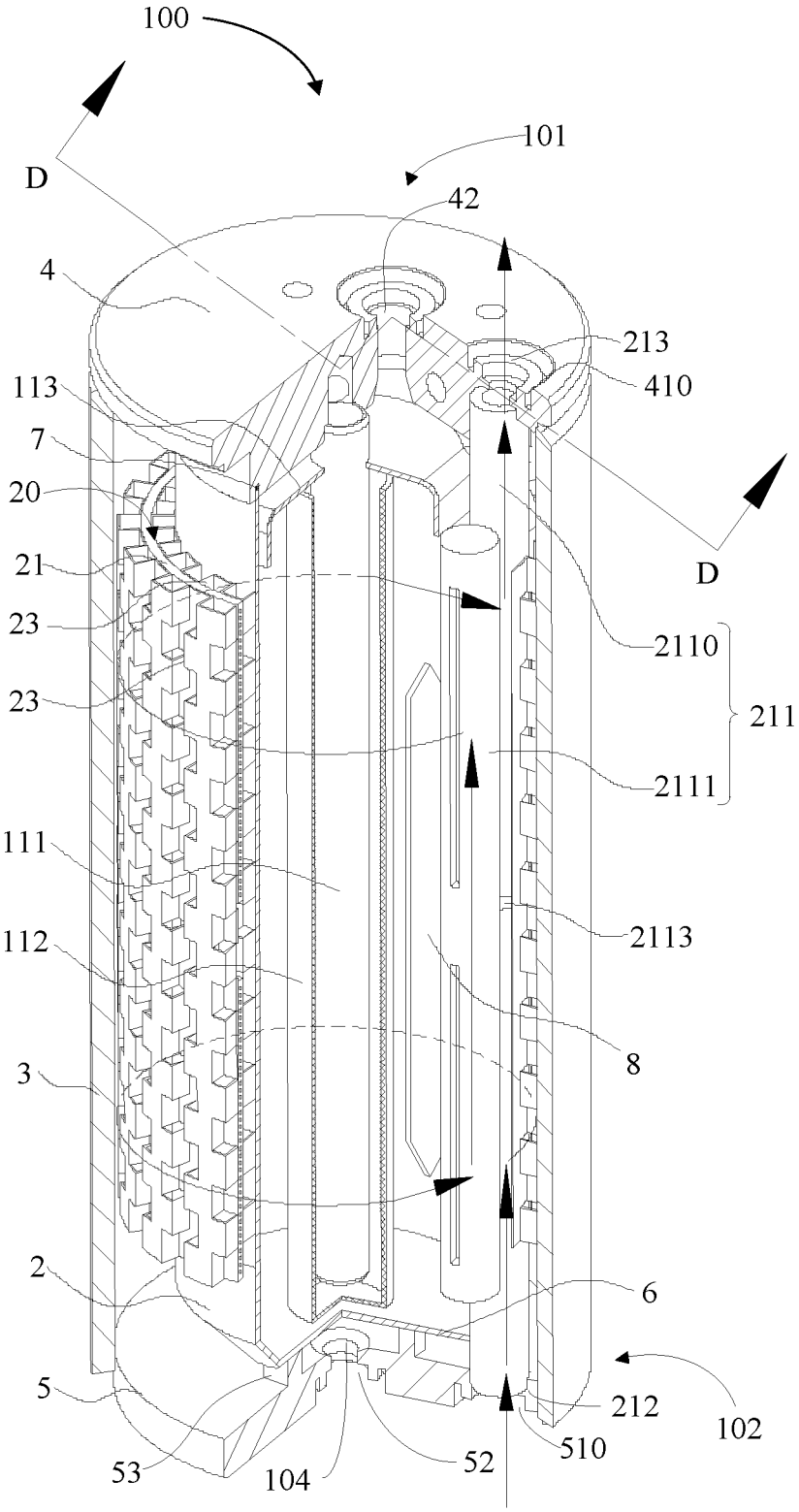
FIG. 53 is a schematic view of the flow direction of the second refrigerant of another gas-liquid separator in accordance with an exemplary embodiment of the present application.

In the case where the gas-liquid separator 100 includes the avoidance portion 29, the sealing element 7 and the boss 53, the flow direction of the second refrigerant is the direction indicated by arrows in FIG. 53. The working principle of the gas-liquid separator 100 when the second refrigerant is circulating is the same as that describe above, which will not be repeated here.

Figure 55:
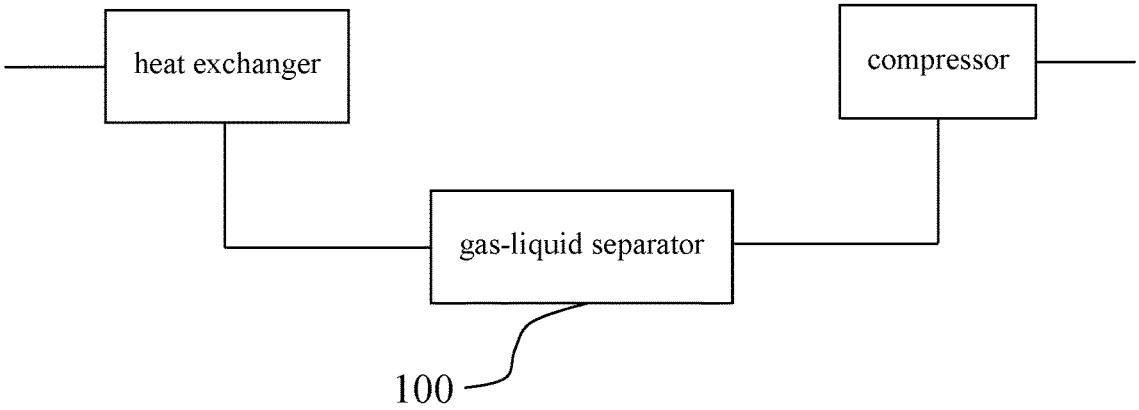
FIG. 55 is a schematic view of connection of a refrigeration system in accordance with an exemplary embodiment of the present application.
Figure 56:
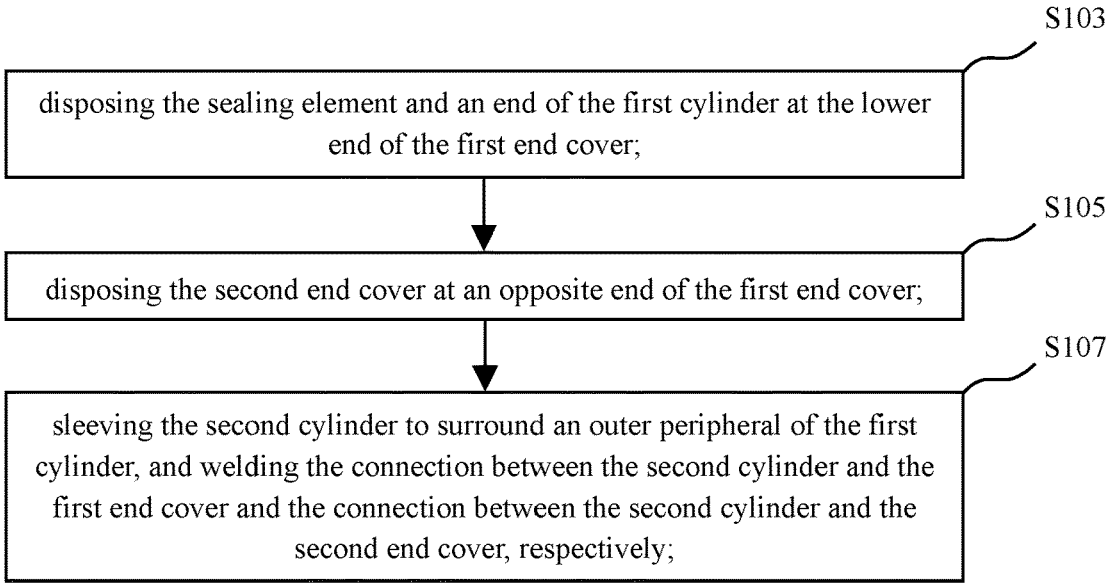
FIG. 56 is an installation flowchart of the gas-liquid separator in accordance with an exemplary embodiment of the present application.

In the air conditioning system provided by the embodiment of the present application, as shown in FIG. 55, an outlet of the heat exchanger can be specifically connected with the first port 42 of the above-mentioned gas-liquid separator 100, and an inlet of the compressor can be specifically connected with a second port 52 of the aforementioned gas-liquid separator.

In addition, this application also provides a method for manufacturing the gas-liquid separator. The manufacturing method provides a first cylinder 2, a second cylinder 3, a first end cover 4, a second end cover 5 and a sealing element 7. The specific structure of the first cylinder 2, the second cylinder 3, the first end cover 4, the second end cover 5, the gas-liquid separation assembly 11 and the heat exchange assembly 20 can be referred to the relevant description of the aforementioned embodiment, which will not be repeated here. These parts or components can be assembled through the following steps S103, S105 and S107. The specific steps 103 to 107 are as follows.

In step S103, the sealing element 7 is disposed between an end of the first cylinder 2 and a lower end of the first end cover 4, wherein the sealing element 7 is in contact with the end of the first cylinder 2 and the lower end of the first end cover 4.

In step S105, the second end cover 5 is disposed at an opposite end of the first end cover 4.

In step S107, the second cylinder 3 surrounds an outer peripheral of the first cylinder 2, and the connection between the second cylinder 3 and the first end cover 4 and the connection between the second cylinder 3 and the second end cover 5 are welded, respectively. Argon arc welding can be used for welding here.

Figure 57:
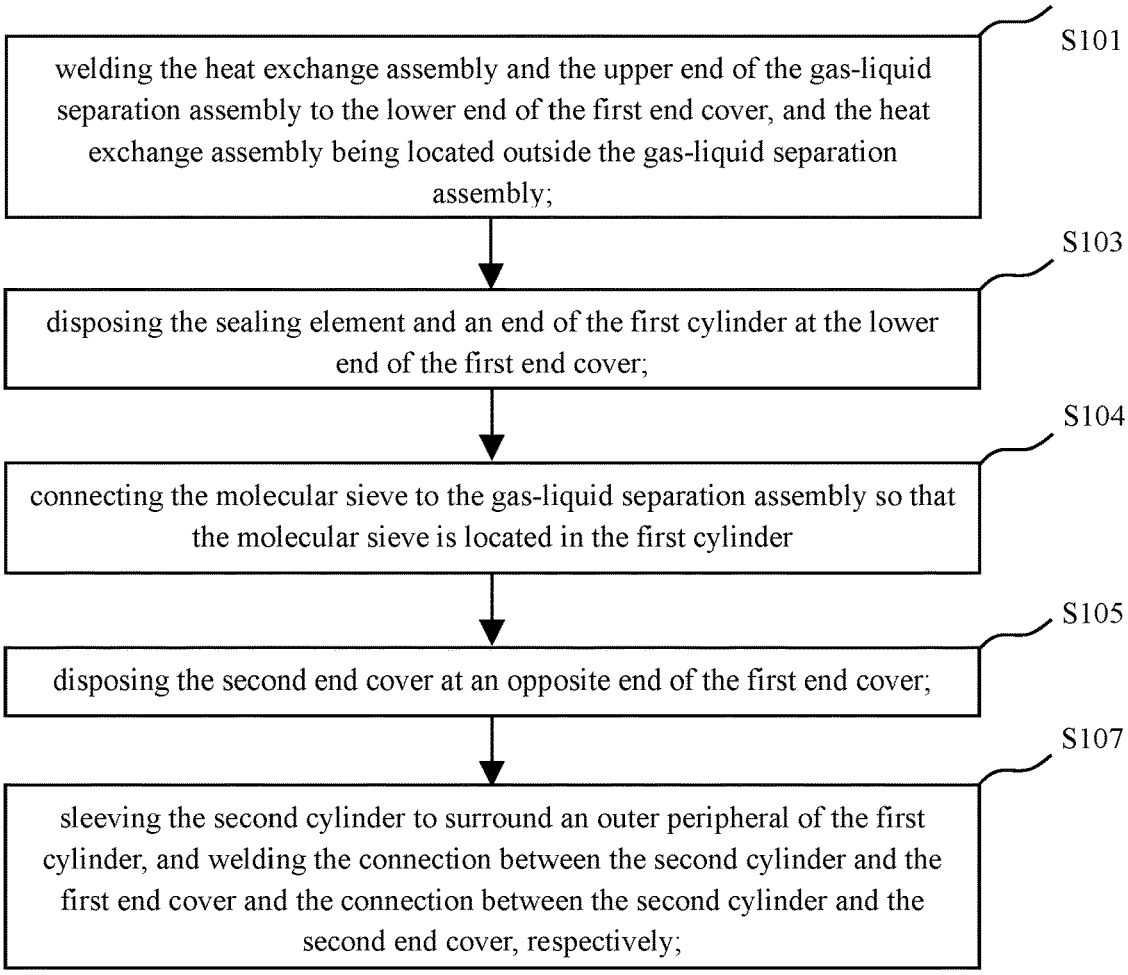
FIG. 57 is an installation flowchart of another gas-liquid separator in accordance with an exemplary embodiment of the present application.

In addition, in some embodiments, as shown in FIG. 57, the manufacturing method further provides a heat exchange assembly 20. Correspondingly, before step S105, the manufacturing method further includes the following step S101.

In step S101, the heat exchange assembly 20 and the upper end of the gas-liquid separation assembly 11 included in the gas-liquid separator 100 are welded to the lower end of the first end cover 4, wherein the heat exchange assembly 20 is located outside the gas-liquid separation assembly 11.

Taking the heat exchange assembly 20 including the aforementioned first collecting pipe 2110, the second collecting pipe 2111 and the flat tube 21 as an example, welding the heat exchange assembly 20 to the lower end of the first end cover 4 can be understood as welding the upper end of the first collecting pipe 2110 to the lower end of the first end cover 4. Specifically, welding is performed at the connection between the first collecting pipe 2110 and the first through hole 410 (for example, the position marked by the reference numeral 91 in FIG. 54). The welding can be performed by flame welding. Of course, other welding methods can also be used for welding.

Taking the gas-liquid separation assembly 11 including the aforementioned gas guide tube 111 as an example, welding the upper end of the gas-liquid separation assembly 11 to the lower end of the first end cover 4 can be understood as welding the upper end of the gas guide tube 111 to the lower end of the first end cover 4. Specifically, welding is performed at the connection between the gas guide tube 111 and the collecting hole 44 (for example, the position marked by the reference numeral 92 in FIG. 54). The welding here can also be welded by flame welding. Of course, other welding methods can also be used for welding.

This application does not limit the sequence of welding the heat exchange assembly 20 and the gas-liquid separation assembly 11 to the first end cover 4, which can be set according to the specific application environment.

It should be noted that the step S101 may be performed before the step S103, as shown in FIG. 57. Of course, the step S101 may also be performed after the step S103.

Taking the step S101 before the step S103 as an example, when the first cylinder 2 is set in the step S103, the first cylinder 2 is located between the gas-liquid separation assembly 11 and the heat exchange assembly 20.

Figure 54:
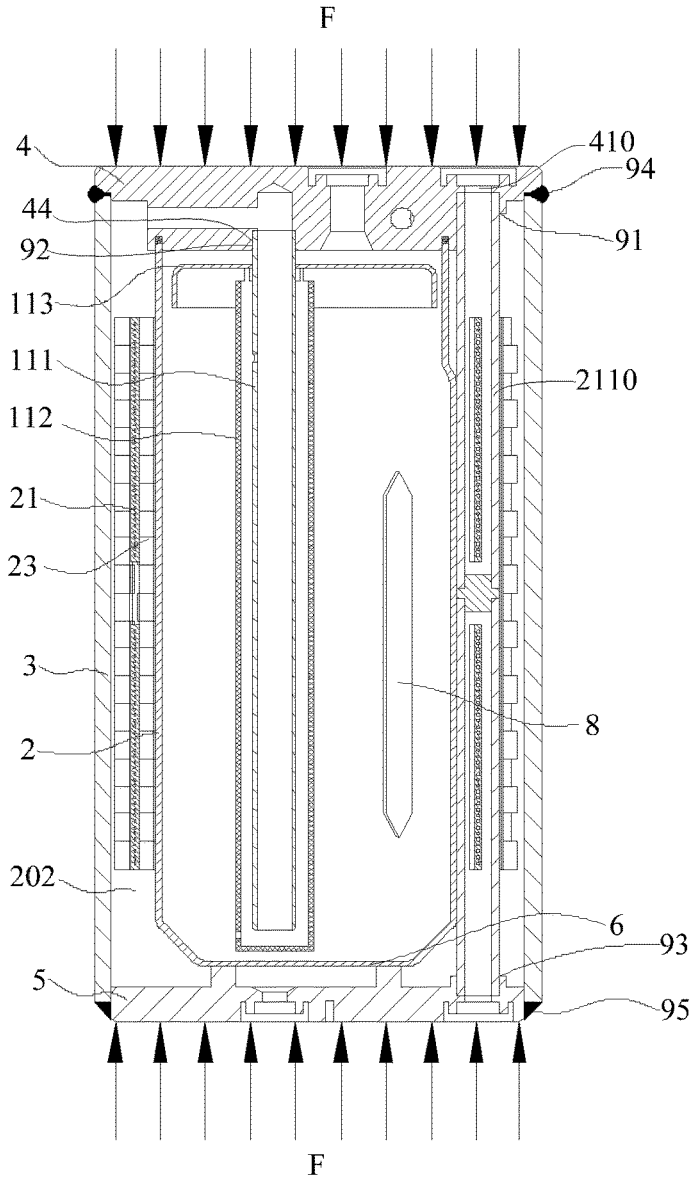
FIG. 54 is a schematic view of installation of the gas-liquid separator in accordance with an exemplary embodiment of the present application.

In addition, in the step S105, specifically, the second end cover 5 is welded to the lower end of the heat exchange assembly 20. After the second end cover 5 is arranged at the opposite end of the first end cover 4, and before the second end cover 5 is welded to the lower end of the heat exchange assembly 20, as shown in FIG. 54, the manufacturing method also includes applying a pre-tightening force F on the first end cover 4 and the second end cover 5. As a result, it makes the connection of components between the first end cover 4 and the second end cover 5 more compact, such as the connection between the first cylinder 2 and the first end cover 4. This can be achieved by clamping tooling.

Taking the heat exchange assembly 20 including the aforementioned first collecting pipe 2110, the second collecting pipe 2111 and the flat tube 21 as an example, welding the second end cover 5 to the lower end of the heat exchange assembly 20 can be understood as welding the lower end of the first collecting pipe 2110 to the upper end of the second end cover 5. Specifically, welding is performed at the connection between the first collecting pipe 2110 and the second through hole 510. The welding can be performed by flame welding. Of course, other welding methods can also be used for welding.

In addition, in some embodiments, the manufacturing method may also provide a molecular sieve 8. Accordingly, before the step S105, the manufacturing method may include a step S104.

In step S104, the molecular sieve 8 is connected to the gas-liquid separation assembly 11 so that the molecular sieve 8 is located in the first cylinder 2. Specifically, in some embodiments, the molecular sieve 8 may be connected to the sleeve 112.

It should be noted that the step S104 may be performed after the step S103. That is, after installing the first cylinder, the molecular sieve 8 is installed in the first cylinder and connected to the gas-liquid separation assembly 11.

In other embodiments, it can also be performed before the step S101. That is, the molecular sieve 8 is connected to the gas-liquid separation assembly 11 in advance, and the molecular sieve 8 is installed along with the installation of the gas-liquid separation 11.

The foregoing descriptions are only preferred embodiments of the preset application, and do not impose any formal restrictions on the present application. Although the present application has been disclosed as above in preferred embodiments, it is not intended to limit the application. Those of ordinary skilled in the art, without departing from the scope of the technical solutions of the present application, can use the technical content disclosed above to make some changes or modifications into equivalent embodiments with equivalent changes. However, without departing from the content of the technical solution of this application, any simple amendments, equivalent changes and modifications made to the above embodiments based on the technical essence of this application still fall within the scope of the technical solution of this application.

What is claimed is:

1. A gas-liquid separator, comprising:

a first cylinder;

a second cylinder surrounded around the first cylinder at a predetermined distance, an interlayer space being formed between the first cylinder and the second cylinder; and a heat exchange assembly, the heat exchange assembly being arranged between the first cylinder and the second cylinder, the heat exchange assembly comprising a collecting pipe, a flat tube disposed in the interlayer space, and a heat dissipation member; the collecting pipe comprising a first collecting pipe and a second collecting pipe disposed in parallel to the first collecting pipe; the first collecting pipe defining a first chamber, a refrigerant inlet communicating with the first chamber, a second chamber, a refrigerant outlet communicating with the second chamber, and a separator separating the first chamber from the second chamber; the second collecting pipe defining a third chamber and a fourth chamber communicating with the third chamber; the flat tube being connected between the first collecting pipe and the second collecting pipe; the flat tube comprising a first C-shaped portion communicating the first chamber and the third chamber and a second C-shaped portion communicating the second chamber and the fourth chamber; the heat dissipation member residing in the interlayer space; the heat dissipation member being in contact with the flat tube and at least one of the first cylinder and the second cylinder; an extension direction of the first collecting pipe being parallel to an axial direction of the first cylinder; wherein at least a part of a side wall surface of the first cylinder is formed with an avoidance portion recessed inwardly, the avoidance portion defines a receiving space communicating with the interlayer space, the first collecting pipe and the second collecting pipe are disposed adjacent to each other, and at least part of the first collecting pipe and at least part of the second collecting pipe are disposed in the receiving space; and wherein the first collecting pipe is longer than the second collecting pipe along the extension direction in a manner that the refrigerant inlet is disposed at a position lower than a bottom end of the second collecting pipe, and the refrigerant outlet is disposed at a position higher than a top end of the second collecting pipe.

2. The gas-liquid separator according to claim 1, wherein the gas-liquid separator further comprises a first end cover covering upper ends of the first cylinder and the second cylinder, the first end cover is provided with a bend channel communicating with an internal cavity of the collecting pipe, the bend channel extends through upper and lower surfaces of the first end cover, the bend channel comprises a first opening located on the upper surface of the first end cover and a second opening located on the lower surface of the first end cover, an end of the collecting pipe is disposed at the second opening, a central axis of the first opening and a central axis of the second opening are not in a same straight line, and the first opening is closer to a center of the first end cover than the second opening.

3. The gas-liquid separator according to claim 2, wherein the first end cover comprises a body portion connected with the second cylinder and a pressing cover disposed on a side of the body portion away from the second cylinder, the bend channel comprises a first section extending vertically and downwardly from the first opening, a second section extending vertically and upwardly from the second opening, and a third section communicating the first section and the second section, the first section extends through upper and lower surfaces of the pressing cover, the third section is disposed at the body portion and extends through the upper surface of the body portion, and the second section is disposed at the body portion and extends through the lower surface of the body portion.

4. The gas-liquid separator according to claim 3, wherein:

the third section is an inclined channel, the gas-liquid separator comprises an intermediate space connected between the first section and the second section, and a block installed in the intermediate space, the block comprises an inclined surface facing the inclined channel, and the inclined surface forms an inclined side wall of the inclined channel; or the third section is an inclined channel, the third section comprises an inclined step surface, the inclined step surface and/or an inclined surface provided on a protrusion of the pressing cover forms an inclined side wall of the inclined channel; or the third section comprises a strip groove extending in a radial direction of the first end cover, the strip groove comprises a first groove portion and a second groove portion, the first groove portion is closer to the center of the first end cover than the second groove portion; and wherein the first groove portion communicates with the first section, and the second groove portion communicates with the second section.

5. The gas-liquid separator according to claim 4, wherein a welding boss corresponding to the second section is provided below the second section, and an upper end of the collecting pipe is disposed in the welding boss.

6. The gas-liquid separator according to claim 2, wherein the gas-liquid separator further comprises a second end cover covering a lower end of the second cylinder, a bend passage is provided in the second end cover, the bend passage communicates with another end of the collecting pipe, the another end of the collecting pipe is provided with a second joint, and the second joint is at least partially disposed in an opening of a lower surface of the second end cover.

7. The gas-liquid separator according to claim 1, wherein the avoidance portion extends from one end of the first cylinder to the other end of the first cylinder in a direction parallel to the axial direction of the first cylinder, and opposite ends of the avoidance portion are respectively provided with openings.

8. The gas-liquid separator according to claim 7, wherein the one end of the first cylinder is open, the other end of the first cylinder is provided with a blocking portion, the blocking portion comprises a first avoidance portion and a second avoidance portion, the first avoidance portion extends from an open end of the first cylinder to the other end of the first cylinder along a direction parallel to the axial direction of the first cylinder, and the second avoidance portion is located in the blocking portion and corresponding to the first avoidance portion.

9. The gas-liquid separator according to claim 7, wherein the avoidance portion comprises a first groove extending in a direction parallel to the axial direction of the first cylinder; or the avoidance portion comprises a second groove and a third groove which are arranged adjacently and extend parallel to the axial direction of the first cylinder, and the second groove and the third groove have a common rib; or the avoidance portion comprises a first straight wall which extends in a direction parallel to the axial direction of the first cylinder.

10. The gas-liquid separator according to claim 1, wherein the avoidance portion comprises a first plane which is formed by extending a preset distance from one end of the first cylinder to the other end of the first cylinder and a slope surface connected with the first plane.

11. The gas-liquid separator according to claim 1, wherein the gas-liquid separator further comprises a baffle sleeved on an outside of the collecting pipe, the heat dissipation member is arranged on a side of the flat tube facing an outer wall of the first cylinder and on a side of the flat tube facing an inner wall of the second cylinder, the collecting pipe is connected with an end of the flat tube.

12. The gas-liquid separator according to claim 11, wherein the baffle comprises one or more of the following:

a first baffle connected to an upper end of the heat dissipation member;

a second baffle connected to a lower end of the heat dissipation member; and a third baffle connected to a side end of the heat dissipation member.

13. The gas-liquid separator according to claim 12, wherein the baffle comprises a baffle main body and a mounting hole for receiving the collecting pipe;

the baffle comprises an outer side surface attached to an inner wall surface of the second cylinder and an inner side surface attached to an outer wall surface of the first cylinder, and the outer surface is a curved surface.

14. The gas-liquid separator according to claim 11, wherein the baffle comprises an outer baffle, the outer baffle comprises a first baffle portion, a second baffle portion and a third baffle portion, the first baffle portion extends along a length direction of the collecting pipe and is connected to a side end of the heat dissipation member, the second baffle portion is clamped to an upper end of the heat dissipation member, the third baffle portion is clamped to a lower end of the heat dissipation member; wherein at least a part of an outer side wall of the first baffle portion is attached to an inner wall surface of the second cylinder; and/or the baffle comprises an inner baffle, and at least a part of a side wall of the inner baffle is attached to an outer wall surface of the first cylinder.

15. The gas-liquid separator according to claim 1, wherein the gas-liquid separator further comprises a first end cover covering upper ends of the first cylinder and the second cylinder, and a second end cover covering a lower end of the second cylinder, a chamber is provided in the first cylinder and communicates with the interlayer space, a sealing element is sandwiched between the first cylinder and the first end cover, and the sealing element is in contact with the first cylinder and the first end cover.

16. The gas-liquid separator according to claim 15, wherein the first end cover comprises a first covering portion which covers the second cylinder and a second covering portion which extends downwardly from the first covering portion and covers the first cylinder; wherein the second covering portion comprises an installation groove and the sealing element is disposed in the installation groove.

17. The gas-liquid separator according to claim 15, wherein a lower end of the first cylinder is sealed; wherein a side of the second end cover facing the first cylinder is provided with a boss or a spacer capable of abutting against a bottom of the first cylinder; or a side of the second end cover facing the first cylinder is provided with a boss and a spacer provided on the boss, and the spacer is capable of abutting against a bottom of the first cylinder.

18. The gas-liquid separator according to claim 15, wherein the first end cover comprises a first port communicating with the chamber, and a first connecting pipe is provided in the first port; the first end cover comprises a channel which extends along a radial direction of the first end cover and is used to communicate with the chamber and the interlayer space between the first cylinder and the second cylinder;

the second end cover comprises a second port, and a second connecting pipe is provided in the second port.

19. A gas-liquid separator, comprising:

a first cylinder;

a second cylinder surrounded around the first cylinder at a predetermined distance, an interlayer space being formed between the first cylinder and the second cylinder;

a first end cover covering upper ends of the first cylinder and the second cylinder; and a heat exchange assembly disposed in the interlayer space, the heat exchange assembly comprising a first collecting pipe, a second collecting pipe disposed in parallel to the first collecting pipe, a flat tube disposed in the interlayer space and connected between the first collecting pipe and the second collecting pipe, and a heat dissipation member being in contact with the flat tube and at least one of the first cylinder and the second cylinder, the first collecting pipe having a first internal cavity, a refrigerant inlet and a refrigerant outlet; the second collecting pipe having a second internal cavity; the flat tube have a plurality of channels communicating the first internal cavity and the second internal cavity;

wherein the first end cover is provided with a bend channel communicating with the refrigerant outlet of the first collecting pipe, the bend channel extends through an upper surface and a lower surface of the first end cover, and the bend channel comprises a first opening located on the upper surface of the first end cover and a second opening located on the lower surface of the first end cover;

wherein a central axis of the first opening and a central axis of the second opening are not in a same straight line, and the first opening is closer to a center of the first end cover than the second opening.

20. An air conditioning system, comprising:

a heat exchanger;

a compressor connected with the heat exchanger by pipelines; and a gas-liquid separator connected between the heat exchanger and the compressor;

the gas-liquid separator further comprising:

a first cylinder;

a second cylinder surrounded around the first cylinder at a predetermined distance, an interlayer space being formed between the first cylinder and the second cylinder; and a heat exchange assembly, the heat exchange assembly being disposed in the interlayer space, the heat exchange assembly comprising a first collecting pipe, a second collecting pipe disposed in parallel to the first collecting pipe, a flat tube disposed in the interlayer space and connected between the first collecting pipe and the second collecting pipe, and a heat dissipation member being in contact with the flat tube and at least one of the first cylinder and the second cylinder, the first collecting pipe having a first internal cavity, a refrigerant inlet and a refrigerant outlet the second collecting pipe having a second internal cavity; the flat tube have a plurality of channels communicating the first internal cavity and the second internal cavity; and an extension direction of the first collecting pipe being parallel to an axial direction of the first cylinder; wherein at least a part of a side wall surface of the first cylinder is formed with an avoidance portion recessed inwardly, the avoidance portion defines a receiving space communicating with the interlayer space, the first collecting pipe and the second collecting pipe are disposed adjacent to each other, and at least part of the first collecting pipe and at least part of the second collecting pipe are disposed in the receiving space;

wherein the first collecting pipe is longer than the second collecting pipe along the extension direction in a manner that the refrigerant inlet is disposed at a position lower than a bottom end of the second collecting pipe, and the refrigerant outlet is disposed at a position higher than a top end of the second collecting pipe;

wherein the refrigerant inlet communicates with an outlet of the heat exchanger, and an outlet of the interlayer space between the first cylinder and the second cylinder communicates with an inlet of the compressor.

* * * * *